US007201778B2

(12) United States Patent
Smith et al.

(10) Patent No.: US 7,201,778 B2
(45) Date of Patent: Apr. 10, 2007

(54) IONIC CROSS-LINKING OF IONIC COTTON WITH SMALL MOLECULAR WEIGHT ANIONIC OR CATIONIC MOLECULES

(75) Inventors: Carl Brent Smith, Raleigh, NC (US); Mustafa Bilgen, Raleigh, NC (US); Peter J. Hauser, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 11/045,225

(22) Filed: Jan. 28, 2005

(65) Prior Publication Data

US 2005/0241073 A1 Nov. 3, 2005

Related U.S. Application Data

(63) Continuation-in-part of application No. 10/756,557, filed on Jan. 13, 2004, now Pat. No. 7,166,135.

(60) Provisional application No. 60/439,649, filed on Jan. 13, 2003.

(51) Int. Cl.
*D06M 11/07* (2006.01)
*D06M 13/322* (2006.01)

(52) U.S. Cl. ..... 8/115.51; 8/115.63; 8/116.1; 8/181; 8/188; 252/8.91

(58) Field of Classification Search ..... 8/554, 8/606, 115.51, 181, 188, 115.63, 116.1; 252/8.91
See application file for complete search history.

(56) References Cited

U.S. PATENT DOCUMENTS 4,067,689 A 1/1978 Perrier et al.
4,149,849 A * 4/1979 Koch et al. ..... 8/574
4,245,992 A * 1/1981 Yamashita et al. ..... 8/461
4,722,739 A * 2/1988 Blanchard et al. ..... 8/597
5,951,719 A 9/1999 Cooper et al.
6,080,687 A * 6/2000 Ishwarlal ..... 442/153
6,336,943 B1 1/2002 Login et al.

OTHER PUBLICATIONS

Hauser et al. "Dyeing cationic cotton with fiber reactive dyes: Effect of reactive chemistries." AATCC Review, May 2002, pp. 36-39.*

International Search Report and Notification of Transmittal with Written Opinion dated Apr. 6, 2006.

Kim et al., "Synthesis of a Quaternary Ammonium Derivative of Chitosan and Its Application to a Cotton Antimicrobial Finish," *Textile Res. Journ.*, vol. 68, No. 6, pp. 428-434 (1998), no month.

International Preliminary Examination Report dated Jan. 5, 2007.

* cited by examiner

*Primary Examiner*—Lorna M. Douyon
*Assistant Examiner*—Tri Nguyen
(74) *Attorney, Agent, or Firm*—Jenkins, Wilson, Taylor & Hunt, P.A.

(57) ABSTRACT

A process for producing an ionic crosslinked fibrous material, such as a cellulosic fabric, paper, or other substrate, wherein the ionic crosslinked fiber exhibits an increased wrinkle resistance angle. A process for producing a cationized chitosan, wherein the cationized chitosan exhibits cationization at the $C_6$ and ring hydroxyl sites and the reactivity of the ring $NH_2$ sites is preserved. A process for applying a polycation to an anionic fibrous material to form an ionic crosslinked fibrous material. A process for producing a cationized fibrous material, wherein the process is performed as a pad-batch process, an exhaust fixation process, a pad-steam process, or a pad-dry-cure process.

17 Claims, 11 Drawing Sheets

Figure 2 – Percent Fixation for Pad-Batch Application

Figure 3: Drying Conditions Effects on Percent Fixation

Figure 4: Curing Conditions Effects on Percent Fixation

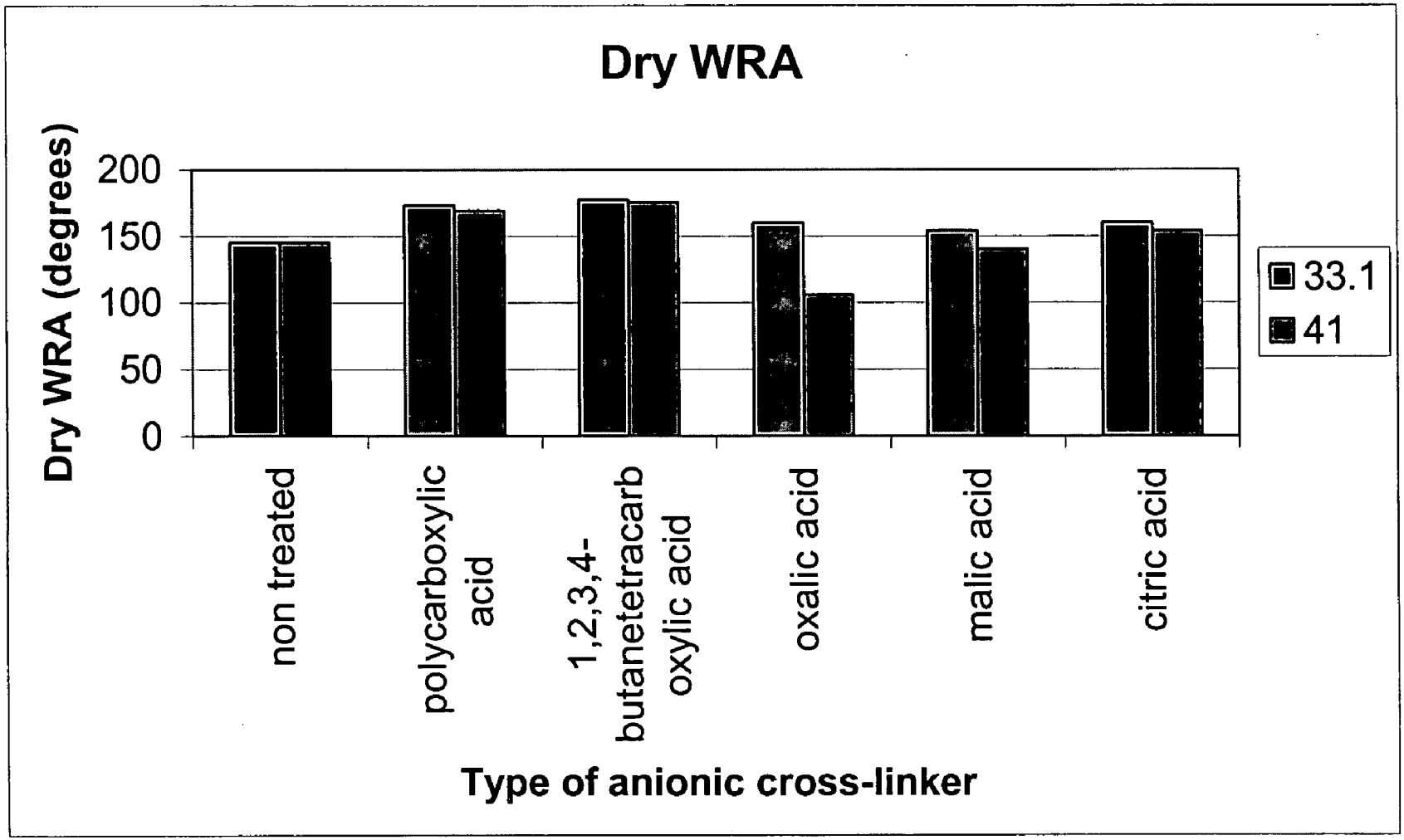
Figure 8: Dry WRA vs. anionic cross linker.

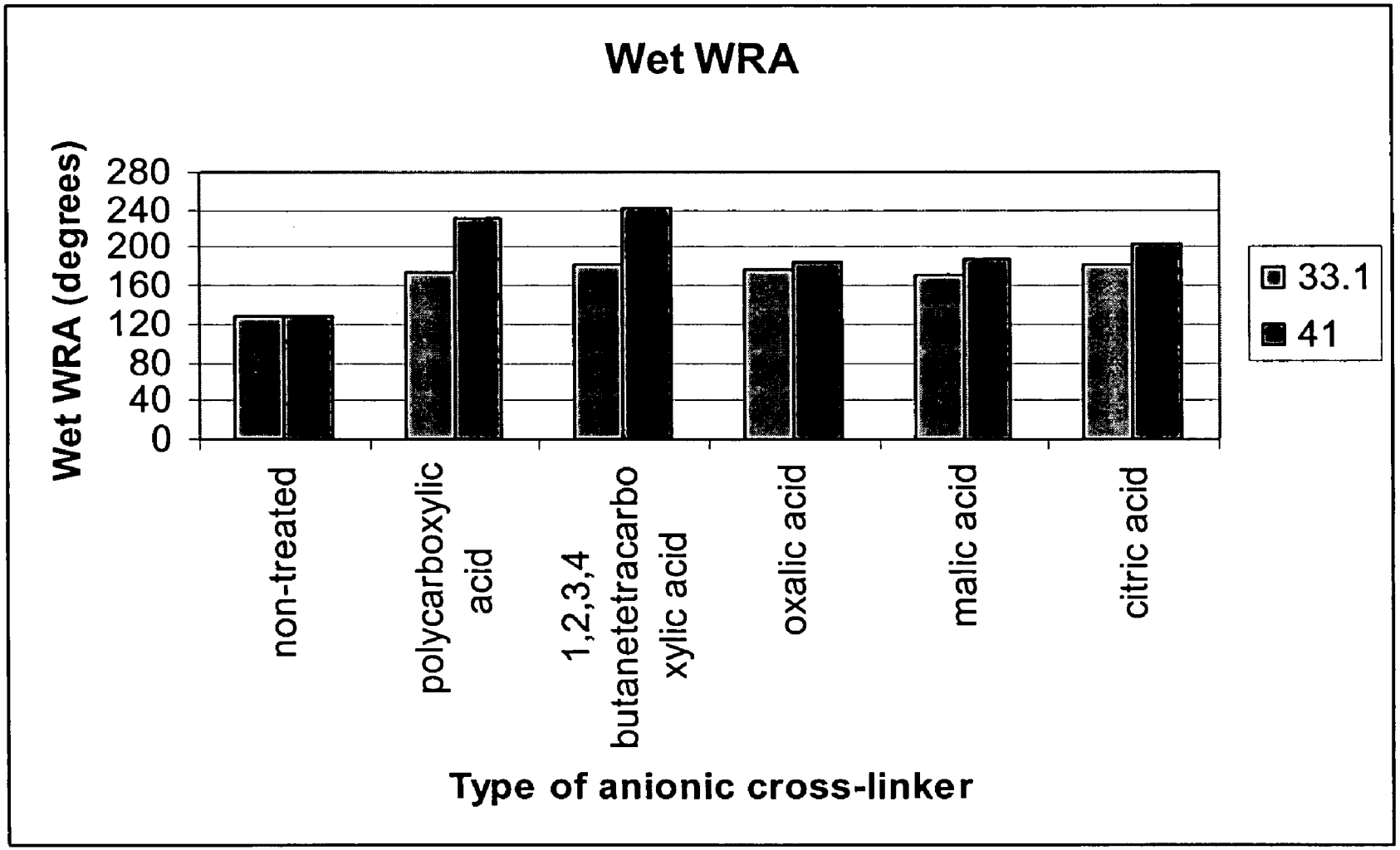
Figure 9: Wet WRA vs. anionic cross linker.

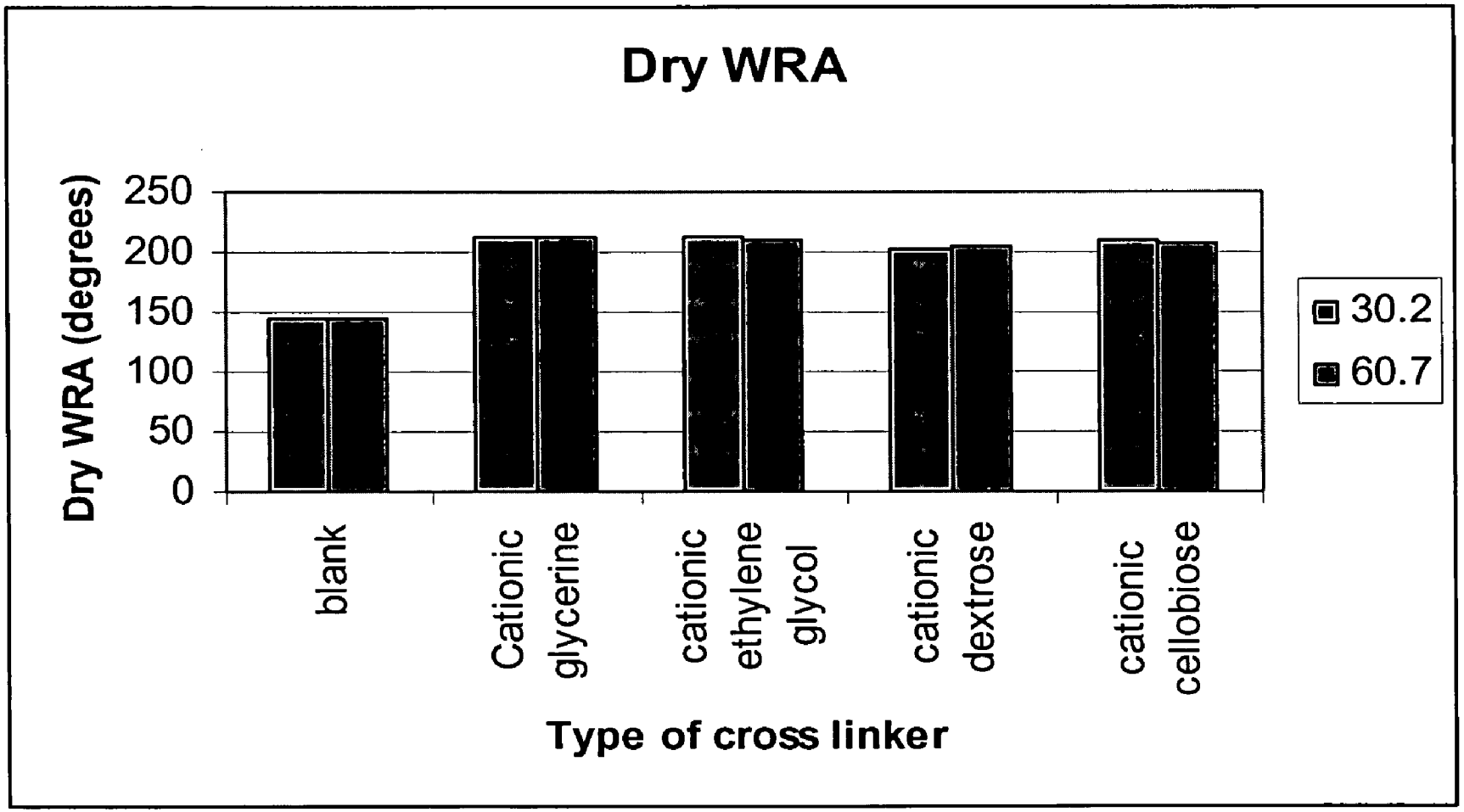
Figure 10: Dry WRA vs. type of cationic cross linker.

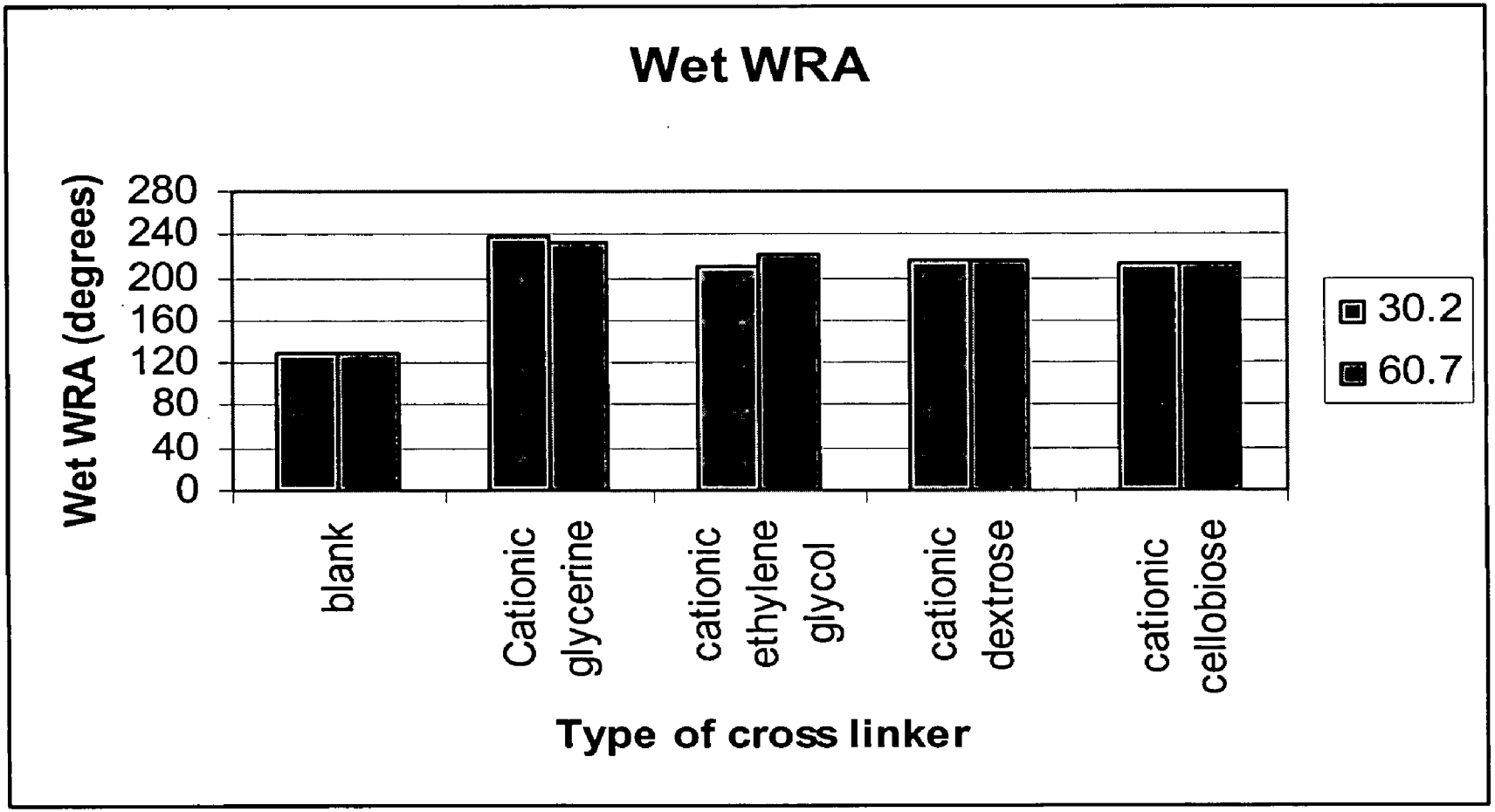
Figure 11: Wet WRA vs. type of cationic cross linker.

IONIC CROSS-LINKING OF IONIC COTTON WITH SMALL MOLECULAR WEIGHT ANIONIC OR CATIONIC MOLECULES

RELATED APPLICATIONS

This application is a continuation-in-part of U.S. patent application Ser. No. 10/756,557, filed Jan. 13, 2004, now U.S. Pat. No. 7,166,135 the disclosure of which is incorporated herein by reference in its entirety and which claims the benefit of and priority to U.S. Provisional Patent Application Ser. No. 60/439,649, filed Jan. 13, 2003, the disclosure of which is incorporated herein by reference in its entirety.

GOVERNMENT INTEREST

This invention was made with Government support under Grant No. 533512 awarded by the United States Department of Agriculture. The Government has certain rights in the invention.

TECHNICAL FIELD

The presently disclosed subject matter relates to a process for producing an ionic crosslinked fibrous material and to the ionic crosslinked material itself. More particularly, the presently disclosed subject matter relates to a process for treating a cellulosic material, such as a cellulosic fabric or paper, with a cation and a reactive anion to form an ionic crosslinked cellulosic material. The presently disclosed subject matter also relates to a process for producing a cationic chitosan and to the cationic chitosan itself.

ABBREVIATIONS

AATCC=American Association of Textile Chemists and Colorists
$AgNO_3$=silver nitrate
ASTM =The American Society for Testing and Materials
CAA=chloroacetic acid
CC=cationized chitosan
CHTAC=3-chloro-2-hydroxypropyl trimethyl ammonium chloride
CMSA=sodium chloromethyl sulfonate
° C.=degrees Celsius
EPTAC=epoxypropyl trimethyl ammonium chloride
g=grams
h=hour
HCl=hydrogen chloride
L=liter
M=molar
min=minute
mL=milliliter
mmol=millimolar
N=normality
$Na_2CO_3$=sodium carbonate
NaOH=sodium hydroxide
OH=hydroxyl radical
WRA=wrinkle recovery angle

BACKGROUND ART

It will be appreciated by those having ordinary skill in the art that cellulose crosslinking is an important textile chemical process that forms the basis for an array of finished textile products. Previous efforts involving ionic crosslinking do not allude to imparting durable press performance, stability, and strength to the substrate. See Ungefug, G. A. and Sello, S. B., Textile Chemist and Colorist, 15(10) 193 (1983). In contrast, the presently disclosed subject matter shows that many desirable mechanical stability properties, such as crease resistance, anti-curl, shrinkage resistance, and durable press, can be imparted to a cellulosic material, such as cotton, by the application of ionic crosslinks. Formaldehyde-based N-methylol crosslinkers are commonly used to impart many of the above-mentioned mechanical stability properties to a cellulosic material, but also give rise to strength loss and the potential to release airborne formaldehyde, a known human carcinogen. See Peterson, H., Cross-Linking with Formaldehyde-Containing Reactants, in Functional Finishes, Vol. II, Part B (Lewis, M. and Sello, S. B., eds., Dekker, New York, 1983), p. 200. Other non-formaldehyde systems, e.g., polycarboxylic acids, have been tested with varying degrees of success. See Yang, C., et al., Textile Res. J., 68(5), 457 (1998); Yang, C. et al., Textile Res. J., 70(3), 230 (2000). The limited success of these systems results from difficulties due to high cost, requirements for stringent processing conditions, and use of exotic catalysts. Accordingly, there is a need for a low-cost, simple process for producing crosslinks in a cellulosic material that gives the material desirable mechanical stability properties, e.g., crease angle recovery performance, without the potential for releasing low molecular weight reactive materials, such as formaldehyde. This need is fulfilled by the ionic crosslinking method described herein by the presently disclosed subject matter.

One possible route to ionic crosslinks involves cationized chitosan (CC), a water-soluble polycation (i.e., a polyelectrolyte) with a high degree of cationization. There are other possible routes to ionic crosslinks that involve other polyelectrolytes. For example, Kim et al. have produced cationized chitosan by using glycidyl trimethylammonium chloride. See Kim, Y., et al., Textile Res. J., 68(6), 428 (1998). The method of cationizing chitosan used by Kim et al., however, produces a cationized chitosan that is substituted at the ring $NH_2$ site, thereby reducing its reactivity and limiting its degree of cationization. Accordingly, there is a need for a process for producing a cationized chitosan in which the substitution of the chitosan is directed toward the $C_6$ and ring hydroxyl sites, thereby allowing a higher degree of cationization and preserving the ring $NH_2$ sites with their associated reactivity.

Additionally, desirable properties can be imparted to a cellulosic material when the material is reacted with a cationizing agent, such as 3-chloro-2-hydroxypropyl trimethyl ammonium chloride (CHTAC) or epoxypropyl trimethyl ammonium chloride (EPTAC), thus rendering it cationic in nature. See Hashem, M., et al., Textile Res. J., 73(11), 1017(2003); Hauser P., et al., AATCC Review, 2(5), 36 (May, 2002); Hauser. P. et al., Color Technol., 117(5), 284 (2001); Hauser, P., Textile Chemist and Colorist & American Dyestuff Reporter, 32(6), 44, (June 2000); Hauser. P., et al., Textile Chemist and Colorist & American Dyestuff Reporter, 32(2), 30 (February 2002); Draper, S. et al., AATCC Review, 2(10), 24 (October 2002); Draper, S., et al., AATCC International Conference and Exhibition Book of Papers, AATCC, Research Triangle Park, NC (Oct. 3, 2002). An important factor in the economic feasibility of such treatments is the efficiency of the utilization of cationizing agent, e.g., CHTAC or EPTAC. Typically, the utilization efficiency of the cationizing agent is less than 100% due to the competing hydrolysis reaction as illustrated for CHTAC in Scheme 1.

Scheme 1.
Cationization of Cellulose and Hydrolysis of EPTAC

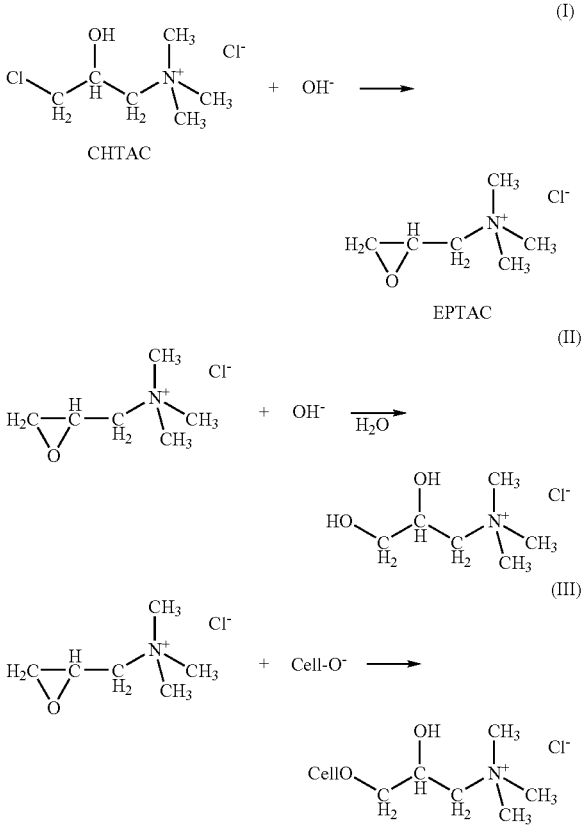

Referring now to Scheme 1, the reaction of CHTAC occurs in two steps. First, the CHTAC is rapidly converted to EPTAC by Reaction I. The EPTAC subsequently reacts more slowly with either water to form a hydrolyzed waste material by Reaction II, or with cellulose or chitosan to form cationized cellulose or cationized chitosan, respectively, by Reaction III. The waste of reactant materials by Reaction II is undesirable and increases the cost of the cationization process and the effluent pollution load. Accordingly, there is a need for improving the efficiency of the process for cationizing cellulosic materials, such as cotton.

SUMMARY

A process for producing an ionic crosslinked fibrous material is disclosed. The process comprises applying a polyelectrolyte, such as a polycation or a polyanion, to an ionic fibrous material to form an ionic crosslinked fibrous material, wherein the polyelectrolyte has a charge opposite that of the ionic fibrous material. In some embodiments, the polycation is formed by reacting a polymer, such as a polysaccharide, with a cationizing agent. In some embodiments, the ionic fibrous material is formed by reacting a fibrous material, such as a cellulosic fabric or paper, with a reactive anion to form an anionic fibrous material. The fibrous material can be selected from either synthetic or natural fibrous materials. In some embodiments, the natural fibrous material comprises a cellulosic fibrous material, such as cotton. The ionic crosslinked fibrous material formed by this process also is disclosed. In some embodiments, the ionic crosslinked fibrous material exhibits an improved wrinkle recovery angle without a loss of strength.

In some embodiments, the process further comprises: (a) reacting a polymer, such as chitosan, with a cationizing agent, such as CHTAC or EPTAC, to form a polycation; (b) reacting a fibrous material, such as cotton, with a reactive anion, such as chloroacetic acid (CAA), to form an anionic fibrous material; and (c) applying the polycation to the anionic fibrous material to form an ionic crosslinked fibrous material.

A process for producing a cationized chitosan is disclosed. The process comprises: (a) mixing a polymer, such as chitosan with a cationizing agent, such as CHTAC or EPTAC, to form a reaction mixture; (b) adding an aqueous alkaline solution, such as an aqueous NaOH solution, to the reaction mixture to maintain the reaction mixture at a first pH range; (c) stirring the reaction mixture for a period of time; (d) heating the reaction mixture to a first temperature range for a period of time; (e) cooling the reaction mixture to a second temperature range; and (f) adding a protic acid, such as acetic acid, to the reaction mixture to adjust the pH to a second pH range to form a cationized chitosan. The cationized chitosan formed by this process also is disclosed. In some embodiments, the cationized chitosan exhibits substitution at the $C_6$ and ring hydroxyl sites, thereby preserving the ring $NH_2$ sites with their associated reactivity.

A process for producing an anionic fibrous material, such as a carboxymethylated cellulosic material, is disclosed. The process comprises: (a) impregnating a fibrous material, such as cotton, with an aqueous alkaline solution, such as an aqueous NaOH solution, for a period of time at a first temperature range to form an alkali-treated fibrous material; (b) squeezing the alkali-treated fibrous material to a wet pickup of about 100%; (c) drying the alkali-treated fibrous material at a second temperature range; (d) steeping the alkali-treated fibrous material at a third temperature range for a period of time in an aqueous solution of a reactive anion, such as CAA, wherein the aqueous solution of the reactive anion is neutralized with a second alkaline compound, such as sodium carbonate, to form a treated fibrous material; (e) squeezing the treated fibrous material to a wet pickup of about 100%; (f) sealing the treated fibrous material in a container; and (g) heating the treated fibrous material for a period of time at a fourth temperature range to form an anionic fibrous material. The process further comprises the steps of washing and drying the anionic fibrous material. In some embodiments, the anionic fibrous material comprises a carboxymethylated cellulosic material.

A process for applying a polycation to an anionic fibrous material is disclosed, wherein the process is performed as a pad-dry process. It is also possible to apply polyelectrolytes of a specific charge to an ionic fibrous material of opposite charge, e.g., a polyanion to cationic cotton or a polycation to anionic cotton. The process comprises: (a) preparing an aqueous solution of the polycation, such as a cationized chitosan; (b) padding an anionic fibrous material, such as a carboxymethylated cellulosic material, through the aqueous solution of the polycation at a wet pickup of about 100% to form a padded anionic fibrous material; and (c) drying the padded anionic fibrous material range to form an ionic crosslinked fibrous material.

Optionally, a process for producing an ionic crosslinked fibrous material is disclosed, wherein the process is performed as a simultaneous pad-batch process. The simultaneous pad-batch process comprises: (a) mixing a cationizing agent, such as CHTAC, with an alkaline compound, such as NaOH, to form a first reaction mixture; (b) mixing the first reaction mixture or a solution of EPTAC with a reactive anion, such as CAA or sodium chloromethyl sulfonate (CMSA), to form a second reaction mixture; (c) padding a fibrous material, such as cotton, through the second reaction mixture to form a treated fibrous material; and (d) batching the treated fibrous material for a period of time at ambient temperature in a sealed container, to form an ionic crosslinked fibrous material.

Optionally, a process for producing an ionic crosslinked fibrous material is disclosed, wherein the process is performed as a sequential pad-batch process. The sequential pad-batch process comprises: (a) reacting a fibrous material, such as cotton, with a reactive anion, such as CAA or CMSA, to form an anionic fibrous material; (b) mixing a cationizing agent, such as CHTAC, with an alkaline compound, such as NaOH, to form a first reaction mixture; (c) padding the anionic fibrous material through the first reaction mixture or a solution of EPTAC to form a padded anionic fibrous material; and (d) batching the padded fibrous material for a period of time at ambient temperature in a sealed container, to form an ionic crosslinked fibrous material.

Additionally, a process for producing a cationized fibrous material is disclosed, wherein the process is performed as a pad-batch process, an exhaust fixation process, a pad-steam process, or a pad-dry-cure process.

The pad-batch process for producing a cationized fibrous material comprises: (a) preparing a first reaction mixture, wherein the first reaction mixture comprises a cationizing agent, such as CHTAC, an alkaline compound, such as NaOH, and mixtures thereof; (b) padding the fibrous material through the first reaction mixture or a solution of EPTAC to a wet pickup of about 100%; (c) preparing a second reaction mixture, wherein the second reaction mixture comprises a cationizing agent, such as CHTAC, an alkaline compound, such as NaOH, and mixtures thereof; (d) padding the fibrous material through the second reaction mixture or a solution of EPTAC to a wet pickup of about 100% to form a padded fibrous material; and (e) batching the padded fibrous material in a sealed container, at a first temperature range for a period of time to form a cationized fibrous material.

The pad-batch process further comprises the steps wherein the first reaction mixture contains either the cationizing agent or the alkaline compound only. The pad-batch process further comprises the steps wherein the second reaction mixture contains either the cationizing agent or the alkaline compound only. The process further comprises the sequence of padding the fibrous material through the first reaction mixture only prior to the batching step. The process further comprises the step of drying the fibrous material after padding it through the first reaction mixture and before padding it through the second reaction mixture.

The pad-batch process further comprises the step of adding an additive to the first reaction mixture, wherein the additive is selected from the group consisting of sodium lauryl sulfate, triethanol amine, ethylenediamine tetraacetic acid, butane tetracarboxylic acid, sodium thiosulfate, sodium tetraborate, sodium chloride, guanidine, diethylamine, and epichlorohydrin.

The pad-batch process further comprises the step of subjecting the fibrous material to a pretreating process prior to padding the fibrous material through the first reaction mixture, wherein the pretreating process comprises: (a) soaking the fibrous material in a pretreatment solution, wherein the pretreatment solution is selected from the group consisting of guanidine, sodium hydroxide, potassium hydroxide, trimethylammonium hydroxide, aqueous ammonia, and liquid ammonia, at a first temperature range for a period of time to form a pretreated fiber; and (b) removing the pretreatment solution from the pretreated fibrous material by one of: (i) washing the pretreated fibrous material with a washing solution, such as water or a guanidine solution; and (ii) drying the pretreated fibrous material at a second temperature range.

Optionally, a process for producing a cationized fibrous material is disclosed, wherein the process is performed as an exhaust fixation process. The exhaust fixation process comprises: (a) mixing a cationizing agent, such as CHTAC, and an alkaline compound, such as NaOH, to form a first reaction mixture; (b) waiting for a first period of time; and (c) adding a fibrous material, such as cotton, to the first reaction mixture for a second period of time.

The exhaust fixation process further comprises the step of adding a second alkaline compound, such as sodium carbonate, during step (c). The exhaust fixation process further comprises the step of adding an additive to the first reaction mixture of step (a), wherein the additive is selected from the group consisting of a $NaOH/Na_2CO_3$ pH 12 buffer solution, triethanol amine, sodium chloride, sodium lauryl sulfate, ethylenediamine tetraacetic acid, and epichlorohydrin. The process further comprises the step of adding a solvent to the first reaction mixture of step (a), wherein the solvent is selected from the group consisting of acetone, methanol, ethanol, and isopropanol.

Alternatively, the exhaust fixation process comprises the sequences of (a) adding the fibrous material to the cationizing agent and then adding the alkaline compound or (b) adding the fibrous material to the alkaline compound and then adding the cationizing agent.

Optionally, a process for producing cationized fibrous material is disclosed, wherein the process is performed as a pad-steam process. The pad-steam process comprises: (a) mixing a cationizing agent, such as CHTAC, and an alkaline compound, such as NaOH, to form a first reaction mixture; (b) padding a fibrous material, such as cotton, through the first reaction mixture or a solution of EPTAC to form a padded fibrous material; (c) drying the padded fibrous material at a first temperature range; and (d) exposing the padded fibrous material to saturated steam at a second temperature range for a period of time. The pad-steam process further comprises the steps of (a), (b), and (d) only, wherein the drying step (c) is not performed.

Optionally, a process for producing a cationized fibrous material is disclosed, wherein the process is a pad-dry-cure process. The pad-dry-cure process comprises: (a) mixing a cationizing agent, such as CHTAC, and an alkaline compound, such as NaOH, to form a first reaction mixture; (b) padding a fibrous material, such as cotton, through the first reaction mixture or a solution of EPTAC to a wet pickup of about 100% to form a padded fibrous material; (c) drying the padded fibrous material at a first temperature range for a first period of time; and (d) curing the padded fibrous material at a second temperature range for a second period of time. The pad-dry-cure process for producing a cationized fibrous material further comprises the step of adding an additive to the first reaction mixture, wherein the additive is selected from the group consisting of sodium chloride, sodium acetate, triethanol amine, and sodium lauryl sulfate.

Accordingly, it is an object of the presently disclosed subject matter to provide a process for producing an ionic crosslinked fibrous material, including a cationic crosslinked fibrous material and an anionic crosslinked fibrous material.

It is another object of the presently disclosed subject matter to produce an ionic crosslinked fibrous material that, in some embodiments, exhibits an improved wrinkle recovery angle without strength loss.

It is another object of the presently disclosed subject matter to produce a cationized chitosan, wherein, in some embodiments, the cationized chitosan exhibits cationization at the $C_6$ and ring hydroxyl sites and the reactivity of the ring $NH_2$ sites is preserved.

It is another object of the presently disclosed subject matter to produce an anionic fibrous material, wherein, in some embodiments, the anionic fibrous material comprises a carboxymethylated cellulose.

Additionally, a process for producing a cationized fibrous material is disclosed, wherein the process is performed as a pad-batch process, an exhaust fixation process, a pad-steam process, or a pad-dry-cure process.

The presently disclosed subject matter further discloses a process for producing an ionic crosslinked fibrous material, the process comprising:

(a) providing an aqueous solution of a low molecular weight anion;
(b) providing a cationic fibrous material;
(c) padding the cationic fibrous material through the aqueous solution of a low molecular weight anion to form a padded cationic fibrous material;
(d) drying the padded cationic fibrous material at a first temperature range to form a dried cationic fibrous material; and
(e) curing the dried cationic fibrous material at a second temperature range to form a crosslinked ionic fibrous material.

In some embodiments, the low molecular weight anion is selected from the group consisting of polycarboxylic acid, 1,2,3,4-butanetetracarboxylic acid, oxalic acid, malic acid, and citric acid.

The presently disclosed subject matter also discloses a process for producing an ionic crosslinked fibrous material, the process comprising:

(a) providing an aqueous solution of a low molecular weight cation;
(b) providing anionic fibrous material;
(c) padding the anionic fibrous material through the aqueous solution of the low molecular weight cation to form a padded anionic fibrous material;
(d) drying the padded anionic fibrous material at a first temperature range to form a dried anionic fibrous material; and
(e) curing the dried anionic fibrous material at a second temperature range to form a crosslinked ionic fibrous material.

In some embodiments, the low molecular weight cation is formed by reacting a low molecular weight compound with a cationizing agent. In some embodiments, the low molecular weight compound is selected from the group consisting of glycerine, ethylene glycol, dextrose, and D-cellobiose. Thus, in some embodiments, the low molecular weight cation is selected from the group consisting of cationic glycerine, cationic ethylene glycol, cationic dextrose, and cationic D-cellobiose.

Accordingly, the presently disclosed subject matter demonstrates that the ionic cross-linking of an ionic cotton can also be accomplished by using lower molecular weight anionic or cationic molecules and does not require the use of a polymeric polyelectrolyte. Importantly, the presently disclosed subject matter demonstrates that the ionic cross-linking of an ionic cotton can be accomplished by using anionic or cationic molecules with as few as three functional groups.

Certain objects of the invention having been stated hereinabove, which are addressed in whole or in part by the present invention, other aspects and objects will become evident as the description proceeds when taken in connection with the accompanying Examples and Drawing as best described herein below.

BRIEF DESCRIPTION OF THE DRAWINGS

FIG. 8 shows the values of dry wrinkle recovery angle (WRA) (in degrees) for various types of anionic cross linkers provided by the presently disclosed subject matter at a cationization of 33.1 (mmol/100 g) and 41 (mmol/100 g).

FIG. 9 shows the values of wet wrinkle recovery angle (WRA) (in degrees) for various types of anionic cross linkers provided by the presently disclosed subject matter at a cationization of 33.1 (mmol/100 g) and 41 (mmol/100 g).

FIG. 10 shows the values of dry wrinkle recovery angle (WRA) (in degrees) for various types of cationic cross linkers of the presently disclosed subject matter at a carboxyl content of 30.2 (mmol/100 g) and 60.7 (mmol/100 g).

FIG. 11 shows the values of wet wrinkle recovery angle (WRA) (in degrees) for various types of cationic cross linkers of the presently disclosed subject matter at a carboxyl content of 30.2 (mmol/100 g) and 60.7 (mmol/100 g).

DETAILED DESCRIPTION OF THE INVENTION

Figure 1:
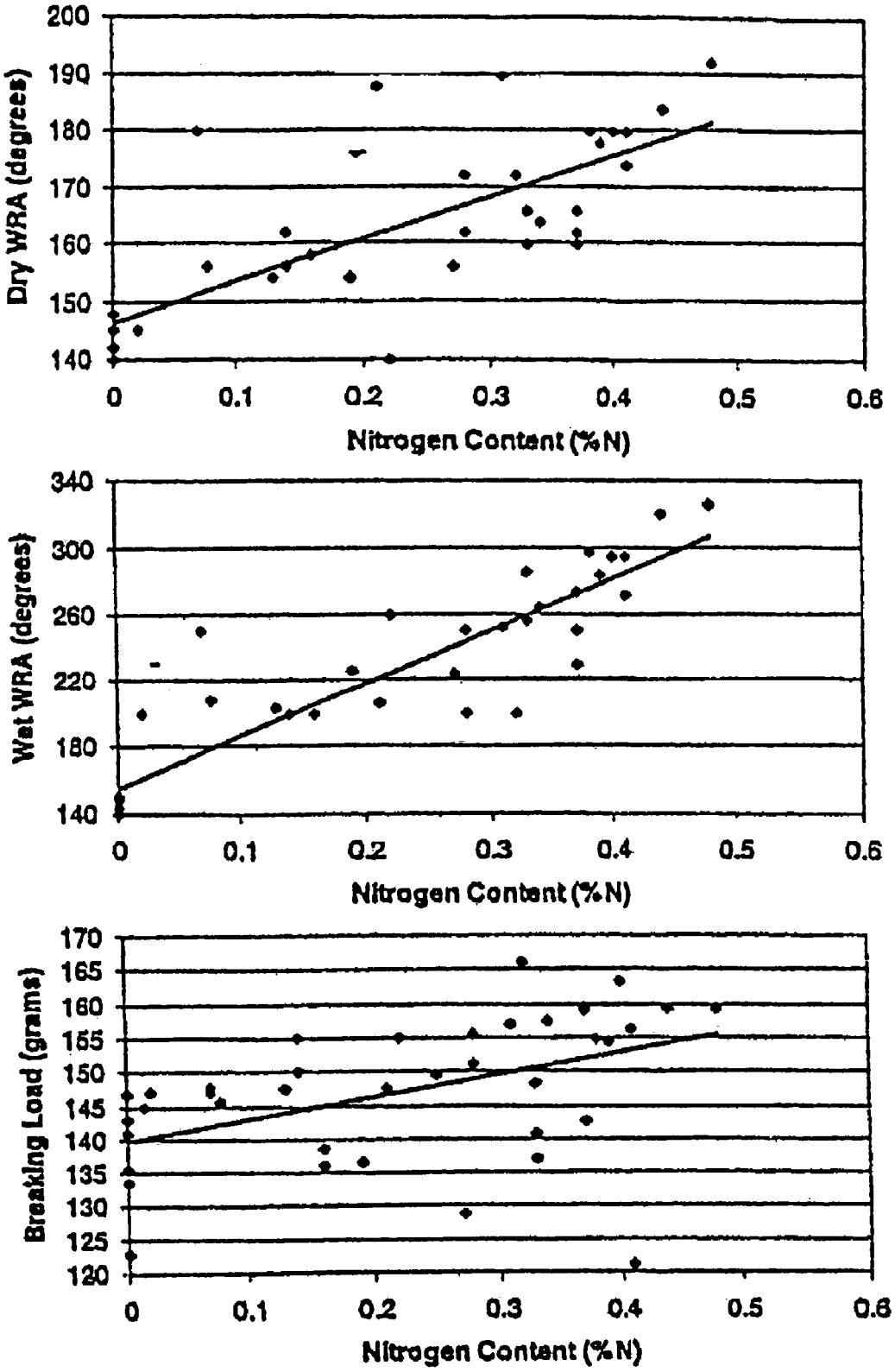
FIG. 1 shows the effects of an ionic crosslinking treatment described in Example 1 on (a) dry wrinkle recovery angle; (b) wet wrinkle recovery angle; and (c) strength of a cellulosic fabric.

The presently disclosed subject matter will now be described more fully hereinafter with reference to the accompanying Examples, in which preferred embodiments are shown. The presently disclosed subject matter can, however, be embodied in different forms and should not be construed as limited to the embodiments set forth herein. Rather, these embodiments are provided so that this disclosure will be thorough and complete, and will fully convey the scope of the embodiments to those skilled in the art.

The presently disclosed subject matter provides a process for forming an ionic crosslinked fibrous material. The process comprises applying a polyelectrolyte to an ionic fibrous material to form an ionic crosslinked fibrous material, wherein the polyelectrolyte has a charge opposite that of the ionic fibrous material.

In some embodiments, the process comprises the steps of reacting a polymer, such as chitosan, with a cationizing agent to form a polycation; reacting a fibrous material with an anionizing agent to form an anionic fibrous material; and applying the polycation to the anionic fibrous material. Surprisingly, in some embodiments, the ionic crosslinked fibrous material formed by this process exhibits an improved wrinkle recovery angle without a loss of strength.

A process for producing a novel cationized chitosan by reacting chitosan with a cationizing agent, such as CHTAC, also is disclosed. In some embodiments, the cationized chitosan formed by this process exhibits substitution at the $C_6$ and ring hydroxyl sites, thereby preserving the ring $NH_2$ sites with their associated reactivity.

The presently disclosed subject matter also provides a process for forming an anionic fibrous material, such as a carboxymethylated cellulosic material, by reacting a fibrous material with a reactive anion, such as CAA. Further, a pad-dry process for applying a polycation to an anionic fibrous material is disclosed.

Optionally, a simultaneous pad-batch process for producing an ionic crosslinked fibrous material is disclosed, wherein a fibrous material is padded through a solution comprising mixture of a cationizing agent, such as CHTAC, and a reactive anion, such as CAA or CMSA, and then batched for a period of time in a sealed container. Alternatively, a sequential pad-batch process for producing an ionic crosslinked fibrous material is disclosed, wherein a fibrous material is first mixed with a reactive anion, such as CAA or CMSA, to form an anionic fibrous material. The anionic fibrous material is then padded through a cationizing solution and batched for a period of time to form an ionic crosslinked fibrous material.

Additionally, a process for producing a cationized fibrous material is disclosed, wherein the process is performed as a pad-batch process, an exhaust fixation process, a pad-steam process, or a pad-dry-cure process.

Process for Producing Ionic Crosslinked Fibrous Material

There are many possible routes to producing an ionic crosslinked fibrous material: (1) make an anionic fibrous material, then react the anionic fibrous material with a polycation; (2) make a cationic fibrous material, then react the cationic fibrous material with a polyanion; (3) add an anionic reactant to a polycation to form a reaction mixture, then react the reaction mixture with a fibrous material; (4) add a cationic reactant to a polyanion to form a reaction mixture, then react the reaction mixture with a fibrous material; (5) react a fibrous material with a cationic agent, then react the fibrous material with an anionic reagent; (6) react a fibrous material with an anionic agent, then react the fibrous material with a cationic agent; and (7) add a cationic and anionic reagent to each other to form a reaction mixture, then react the reaction mixture with a fibrous material. In the above description, the "reactant" is a small molecule, such as CHTAC, EPTAC, or CAA, whereas the polyelectrolyte is a large molecule, such as a polymer.

The presently disclosed subject matter provides a process for forming an ionic crosslinked fibrous material. The process comprises applying a polyelectrolyte to an ionic fibrous material to form an ionic crosslinked fibrous material, wherein the polyelectrolyte has a charge opposite that of the ionic fibrous material. In some embodiments, the polyelectrolyte comprises one of a polycation and a polyanion. In some embodiments, the polycation is formed by reacting a polymer with a cationizing agent. In some embodiments, the polymer comprises a polysaccharide. In some embodiments, the polyelectrolyte is a low molecular weight polymer. In some embodiments, the ionic fibrous material comprises an anionic fibrous material. In some embodiments, the anionic fibrous material is formed by reacting a fibrous material with a reactive anion. In some embodiments, the fibrous material is selected from the group consisting of a synthetic fibrous material and a natural fibrous material. In some embodiments, the natural fibrous material comprises a cellulosic fibrous material. In some embodiments, the cellulosic fibrous material comprises cotton. An ionic crosslinked fibrous material formed by this process also is disclosed. In some embodiments, the ionic crosslinked fibrous material exhibits an improved wrinkle recovery angle without a loss of strength.

In some embodiments, the process for producing an ionic crosslinked fibrous material comprises:

(a) reacting a polymer with a cationizing agent to form a polycation;
(b) reacting a fibrous material with a reactive anion to form an anionic fibrous material; and
(c) applying the polycation to the anionic fibrous material to form an ionic crosslinked fibrous material.

In some embodiments, the polycation is applied to the anionic fibrous material by (a) preparing an aqueous solution of the polycation; (b) padding the anionic fibrous material through the aqueous solution of the polycation to form a padded anionic fibrous material; and (c) drying the padded anionic fibrous material to form an ionic crosslinked fibrous material.

In some embodiments, the aqueous solution of the polycation comprises an aqueous solution of cationized chitosan. In some embodiments, the concentration range of the aqueous solution of the polycation comprises a weight percent concentration of about 0% to about 6%. In some embodiments, the drying occurs at a temperature ranging from about 95° C. to 115° C. In some embodiments, the anionic fibrous material comprises a carboxymethylated cellulosic material.

In some embodiments, the process further comprises padding the anionic fibrous material through an aqueous solution of the polycation to a wet pickup of about 100%.

In some embodiments, the process is performed as a pad-dry process. In some embodiments, the fibrous material comprises cotton.

Optionally, in some embodiments, the presently disclosed subject matter provides a process for producing an ionic crosslinked fibrous material comprising:

(a) mixing a cationizing agent with an alkaline compound to form a first reaction mixture;
(b) mixing the first reaction mixture or a solution of EPTAC with a reactive anion to form a second reaction mixture;
(c) padding a fibrous material through the second reaction mixture to form a treated fibrous material; and
(d) maintaining the treated fibrous material for a period of time at ambient temperature in a sealed container to form an ionic crosslinked fibrous material.

In some embodiments, the cationizing agent comprises CHTAC. In some embodiments, the first cationizing agent comprises a mixture of CHTAC and a CAA or CMSA adduct. In some embodiments, the alkaline compound comprises NaOH. In some embodiments, the reactive anion is selected from the group consisting of CAA and CMSA. In other embodiments, the cationizing agent is formed by the process comprising mixing a first cationizing agent with an alkaline compound to form a second cationizing agent. In some embodiments, the first cationizing agent comprises CHTAC. In some embodiments, the alkaline compound, comprises NaOH. In some embodiments, the second cationizing agent formed comprises EPTAC.

In some embodiments, the ambient temperature ranges from about 20° C. to about 25° C. In some embodiments, a mol ratio range of the cationizing agent to the alkaline compound comprises about 1:2 to about 1:2.5.

In some embodiments, the process is performed as a simultaneous pad-batch process. In some embodiments, the fibrous material comprises cotton.

Optionally, in some embodiments, the presently disclosed subject matter provides a process for producing an ionic crosslinked fibrous material comprising:

(a) reacting a fibrous material with a reactive anion to form an anionic fibrous material;
(b) mixing a cationizing agent with an alkaline compound to form a first reaction mixture;
(c) padding the anionic fibrous material through the first reaction mixture or a solution of EPTAC to form a treated anionic fibrous material; and
(d) batching the treated anionic fibrous material for a period of time at ambient temperature in a sealed container to form an ionic crosslinked fibrous material.

In some embodiments, the reactive anion comprises CAA or CMSA. In some embodiments, the cationizing agent comprises CHTAC. In some embodiments, the cationizing agent comprises a mixture of CHTAC and a CAA or CMSA adduct. In some embodiments, the cationizing agent is formed by the process comprising mixing a first cationizing agent with an alkaline compound to form a second cationizing agent. In some embodiments, the first cationizing agent comprises CHTAC. In some embodiments, the alkaline compound comprises NaOH. In some embodiments, the second cationizing agent formed by this process comprises EPTAC. In some embodiments, the ambient temperature ranges from about 20° C. to about 25° C. In some embodiments, a mol ratio range of the cationizing agent to the alkaline compound comprises about 1:2 to about 1:2.5.

In some embodiments, the process is performed as a sequential pad-batch process. In some embodiments, the fibrous material comprises cotton.

Process for Producing a Cationized Chitosan Polycation

In some embodiments of the presently disclosed subject matter, cationized chitosan is used as a polycation. Accordingly, the presently disclosed subject matter provides a process for producing a cationized chitosan polycation. The process can comprise:

(a) mixing a polymer with a cationizing agent to form a reaction mixture;
(b) adding an aqueous alkaline solution to the reaction mixture to maintain the reaction mixture at a first pH range;
(c) stirring the reaction mixture for a period of time;
(d) heating the reaction mixture to a first temperature range for a period of time;
(e) cooling the reaction mixture to a second temperature range; and
(f) adding a protic acid to the reaction mixture to adjust the pH to a second pH range to form a cationized chitosan.

In some embodiments, the polymer comprises a N-deacetylated chitin or a partially N-deacetylated chitin. In some embodiments, the cationizing agent comprises CHTAC. In some embodiments, the aqueous alkaline solution comprises an aqueous NaOH solution. In some embodiments, the first pH range comprises a pH of about 10 to a pH of about 11. In some embodiments, the second pH range comprises a pH of about 6.5 to a pH of about 7.5. In some embodiments, the first temperature range comprises about 90° C. to 100° C. and the second temperature ranges comprises about 20° C. to about 25° C. In some embodiments, the protic acid comprises acetic acid.

In some embodiments, the cationized chitosan exhibits cationization at the $C_6$ and ring hydroxyl sites. In some embodiments, the reactivity of the ring $NH_2$ sites of the chitosan is preserved.

Process for Producing an Ionic Fibrous Material

The presently disclosed subject matter is based on reactions of a fibrous material, such as cellulose, with materials, such as CAA or CHTAC, which impart an ionic character to the cellulose. These reactions produce an ionic fibrous material that can then sorb a polyelectrolyte of opposite charge, i.e., either a polyanion or a polycation, to form crosslinks. Examples of the production of ionic cellulose are shown in Scheme 2.

$$ClCH_2COO^- + \text{Cellulose-OH} \rightarrow \text{Cellulose-O}-CH_2COO^-$$

(a) Preparation of Anionic Cellulose by Reaction of Cellulose with CAA $$ClCH_2-CH_2OH-CH_2-N^+(CH_3)_2 + \text{Cellulose-OH} \rightarrow \text{Cellulose-O}-CH_2CH_2OHCH_2N^+(CH_3)_3$$

(b) Preparation of Cationic Cellulose by Reaction with CHTAC

Scheme 2. Reactions of Cellulose with Materials that Impart an Ionic Character.

In the examples provided in Scheme 2, the crosslinks are bonded to cellulose through a stable ether linkage.

Ionic cellulose can be produced from several possible routes. For example, anionic cellulose can be produced by reacting cellulose materials with vinyl sulfone or chlorotriazine derivatives containing anionic groups (e.g., compounds similar to fiber reactive dyes), by reacting cellulose materials with CAA to produce partially carboxymethylated cellulose, or by reacting cellulose materials with CMSA. See Hashem, M., et al., Molecular Crystals and Liquid Crystals Science and Technology Section A: Molecular and Liquid Crystals, 353, 109 (2000). In some embodiments, the presently disclosed subject matter provides processes for producing an anionic fibrous material by reacting fibers with CAA or CMSA. In some embodiments, the anionic fibrous material formed by the disclosed processes comprises a carboxymethylated cellulose.

Further, in some embodiments, the presently disclosed subject matter provides a process for producing a cationic fibrous material by reacting a fibrous material with a cationizing agent, such as CHTAC or EPTAC. In some embodiments, the process for producing a cationic fibrous material comprises a pad-batch process, an exhaust fixation process, a pad-steam process, or a pad-dry-cure process.

a. Process for Producing an Anionic Fibrous Material

The presently disclosed subject matter provides a process for forming an anionic fibrous material by reacting a fibrous material with a reactive anion to form an anionic fibrous material. In some embodiments, an anionic fibrous material is formed by:

(a) impregnating a fibrous material with an aqueous alkaline solution for a period of time at a first temperature range to form an alkali-treated fibrous material;
(b) squeezing the alkali-treated fibrous material to a wet pickup of about 100%;
(c) drying the alkali-treated fibrous material at a second temperature range;

(d) steeping the alkali-treated fibrous material for a period of time at a third temperature range in an aqueous solution of a reactive anion to form a treated fibrous material;

(e) squeezing the treated fibrous material of step (d) to a wet pickup of about 100%;

(f) sealing the treated fibrous material in a container; and (g) heating the treated anionic fibrous material for a period of time to a fourth temperature range.

In some embodiments, the process further comprises the steps of washing and drying the anionic fibrous material. In some embodiments, the process further comprises the step of neutralizing the aqueous solution of the reactive anion of step (d) above with a second alkaline compound, such as sodium carbonate, at concentrations ranging from about 0 M to about 3.0 M.

In some embodiments, the aqueous alkaline solution of step (a) above comprises an aqueous sodium hydroxide solution. In some embodiments, the first and third temperature ranges comprise about 20° C. to about 25° C.; the second temperature range comprises about 50° C. to about 70° C.; and the fourth temperature range comprises about 60° C. to about 80° C. In some embodiments, the reactive anion of step (d) above comprises chloroacetic acid. In some embodiments, the anionic fibrous material formed by this process comprises a carboxymethylated cellulosic material.

b. Process for Producing a Cationic Fibrous Material

The presently disclosed subject matter also provides a process for producing a cationic fibrous material. In one embodiment, the process for producing cationized fibrous material comprises:

(a) preparing a first reaction mixture, wherein the first reaction mixture comprises a cationizing agent, an alkaline compound, and mixtures thereof;

(b) padding the fibrous material through the first reaction mixture or a solution of EPTAC to a wet pickup of about 100% to form a first padded fibrous material;

(c) preparing a second reaction mixture, wherein the first reaction mixture comprises a cationizing agent, an alkaline compound, and mixtures thereof;

(d) padding the fibrous material through the second reaction mixture or a solution of EPTAC to a wet pickup of about 100% to form a second padded fibrous material; and (e) batching the padded fibrous material in a sealed container at a first temperature range for a period of time to form a cationized fibrous material.

In some embodiments, the cationizing agent comprises CHTAC. In some embodiments, the alkaline compound comprises NaOH. In some embodiments, the cationizing agent is formed by the process of mixing CHTAC and NaOH, wherein the cationizing agent formed comprises EPTAC. In some embodiments, the first reaction mixture contains the cationizing agent only. In other embodiments, the first reaction mixture contains the alkaline compound only. In some embodiments, the cationizing agent of the second reaction mixture comprises CHTAC. In other embodiments, the cationizing agent of the second reaction mixture comprises EPTAC. In some embodiments, the alkaline compound of the second reaction mixture comprises NaOH. In some embodiments, the second reaction mixture contains the cationizing agent only. In other embodiments, the second reaction mixture contains the alkaline compound only. In some embodiments, the first temperature range comprises about 20° C. to about 25° C.

In some embodiments, the process for producing a cationic fibrous material comprises the steps of (a), (b), and (e) only. In some embodiments, the process for producing a cationic fibrous material comprises drying the fibrous material after step (b). In some embodiments, the process for producing a cationic fibrous material comprises the step of adding an additive to the first reaction mixture, wherein the additive is selected from the group consisting of sodium lauryl sulfate, triethanol amine, ethylenediamine tetraacetic acid, butane tetracarboxylic acid, sodium thiosulfate, sodium tetraborate, sodium chloride, guanidine, diethylamine, and epichlorohydrin.

In some embodiments, the process for producing a cationic fibrous material further comprises the step of subjecting the fibrous material to a pretreating process prior to padding the fibrous material through the first reaction mixture, wherein the pretreating process comprises:

(a) soaking the fibrous material in a pretreatment solution at a first temperature range for a period of time to form a pretreated fiber; and (b) removing the pretreatment solution from the pretreated fibrous material by one of:

(i) washing the pretreated fibrous material with a washing solution; and (ii) drying the pretreated fibrous material at a second temperature range.

In some embodiments, the pretreatment solution is selected from the group consisting of guanidine, sodium hydroxide, potassium hydroxide, trimethylammonium hydroxide, aqueous ammonia, and liquid ammonia. In some embodiments, the first temperature range comprises about 20° C. to about 25° C., under the proviso that the pretreatment solution does not comprise liquid ammonia. In embodiments wherein the pretreatment solution comprises liquid ammonia, the first temperature range comprises about −75° C. to about −80° C. In some embodiments, the washing solution is selected from the group consisting of water and guanidine. In some embodiments, the second temperature range comprises about 20° C. to about 25° C. In some embodiments, the process is performed as a pad-batch process. In some embodiments, the fibrous material comprises cotton.

Optionally, in some embodiments, the process for producing cationized fibrous material comprises:

(a) mixing a cationizing agent and an alkaline compound to form a first reaction mixture;

(b) waiting for a first period of time; and (c) adding a fibrous material to the first reaction mixture or a solution of EPTAC for a second period of time.

In some embodiments, the cationizing agent comprises CHTAC and the alkaline compound comprises NaOH. In some embodiments, the first period of time comprises from about 1 min to about 15 min, and the second period of time comprises from about 80 min to about 100 min.

In some embodiments, the process further comprises the step of adding a second alkaline compound to the reaction mixture during step (c). In some embodiments, the second alkaline compound comprises sodium carbonate.

In some embodiments, the process further comprises the step of adding an additive to the first reaction mixture, wherein the additive is selected from the group consisting of a $NaOH/Na_2CO_3$ pH 12 buffer solution, triethanol amine, sodium chloride, sodium lauryl sulfate, ethylenediamine tetraacetic acid, and epichlorohydrin.

In some embodiments, the process further comprises adding a solvent to the first reaction mixture, wherein the solvent is selected from the group consisting of acetone, methanol, ethanol, and isopropanol.

In some embodiments, the process further comprises the sequence of adding the fibrous material to the cationizing agent and then adding the alkaline compound. In other embodiments, the process further comprises the sequence of adding the fibrous material to the alkaline compound and then adding the cationizing agent.

In some embodiments, the process is performed as an exhaust fixation process. In some embodiments, the fibrous material comprises cotton.

Optionally, in some embodiments, the process for producing cationized fibrous material comprises:

(a) mixing a cationizing agent and an alkaline compound to form a first reaction mixture;

(b) padding a fibrous material through the first reaction mixture or a solution of EPTAC to form a padded fibrous material;

(c) drying the padded fibrous material at a first temperature range; and (d) exposing the padded fibrous material to saturated steam at a second temperature range for a period of time.

In some embodiments, the cationizing agent comprises CHTAC and the alkaline compound comprises NaOH. In some embodiments, the first temperature range comprises about 35° C. to about 45° C. and the second temperature range comprises about 95° C. to about 105° C. In some embodiments, the process further comprises the steps of (a), (b), and (d) only.

In some embodiments, the process is performed as a pad-steam process. In some embodiments, the fibrous material comprises cotton.

Optionally, in some embodiments, the process for producing cationized fibrous material comprises:

(a) mixing a cationizing agent and an alkaline compound to form a first reaction mixture;

(b) padding a fibrous material through the first reaction mixture or a solution of EPTAC to a wet pickup of about 100% to form a padded fibrous material;

(c) drying the padded fibrous material at a first temperature range for a first period of time; and (d) curing the padded fibrous material at a second temperature range for a second period of time.

In some embodiments, the cationizing agent comprises CHTAC and the alkaline compound comprises NaOH. In some embodiments, a mol ratio range of the alkaline compound to the cationizing agent comprises about 0.50:1 to about 2.5:1. In some embodiments, the first temperature range comprises about 20° C. to about 100° C. and the second temperature range comprises about 40° C. to about 130° C. In some embodiments, the first period of time comprises about 1 min to about 15 min and the second period of time comprises about 1 min to about 30 min.

In some embodiments, the process further comprises the step of adding an additive to the first reaction mixture, wherein the additive is selected from the group consisting of sodium chloride, sodium acetate, triethanol amine, and sodium lauryl sulfate.

In some embodiments, the process is performed as a pad-dry-cure process. In some embodiments, the fibrous material comprises cotton.

Further, in some embodiments, the presently disclosed subject matter describes a process for producing an ionic crosslinked fibrous material, the process comprising:

(a) providing an aqueous solution of a low molecular weight anion;

(b) providing a cationic fibrous material;

(c) padding the cationic fibrous material through the aqueous solution of a low molecular weight anion to form a padded cationic fibrous material;

(d) drying the padded cationic fibrous material at a first temperature range to form a dried cationic fibrous material; and (e) curing the dried cationic fibrous material at a second temperature range to form a crosslinked ionic fibrous material.

In some embodiments, the low molecular weight anion is selected from the group consisting of polycarboxylic acid, 1,2,3,4-butanetetracarboxylic acid, oxalic acid, malic acid, and citric acid. In some embodiments, the cationic fibrous material is formed by reacting a fibrous material with a cationizing agent.

In some embodiments, the fibrous material is selected from one of a synthetic fibrous material and a natural fibrous material. In some embodiments, the natural fibrous material comprises cotton.

In some embodiments, the cationizing agent comprises 3-chloro-2-hydroxypropyl trimethyl ammonium chloride (CHTAC).

In some embodiments, the first temperature range comprises about 70° C. to about 100° C. In some embodiments, the second temperature range comprises about 125° C. to about 155° C.

In some embodiments, the crosslinked ionic fibrous material has a dry wrinkle recovery angle ranging from about 145 degrees to about 180 degrees. In some embodiments, the crosslinked ionic fibrous material has a wet wrinkle recovery angle ranging from about 130 degrees to about 250 degrees.

In some embodiments, the presently disclosed subject matter describes a process for producing an ionic crosslinked fibrous material, the process comprising:

(a) providing an aqueous solution of a low molecular weight cation;

(b) providing anionic fibrous material;

(c) padding the anionic fibrous material through the aqueous solution of the low molecular weight cation to form a padded anionic fibrous material;

(d) drying the padded anionic fibrous material at a first temperature range to form a dried anionic fibrous material; and (e) curing the dried anionic fibrous material at a second temperature range to form a crosslinked ionic fibrous material.

In some embodiments, the low molecular weight cation is formed by reacting a low molecular weight compound with a cationizing agent. In some embodiments, the low molecular weight compound is selected from the group consisting of glycerine, ethylene glycol, dextrose, and D-cellobiose. Thus, in some embodiments, the low molecular weight cation is selected from the group consisting of cationic glycerine, cationic ethylene glycol, cationic dextrose, and cationic D-cellobiose.

In some embodiments, the anionic fibrous material is formed by reacting a fibrous material with a sodium salt of monochloroacetic acid. In some embodiments, the fibrous material is selected from one of a synthetic fibrous material and a natural fibrous material. In some embodiments, the natural fibrous material comprises cotton.

In some embodiments, the first temperature range comprises about 70° C. to about 100° C. In some embodiments, the first temperature range comprises about 70° C. to about 100° C. In some embodiments, the second temperature range comprises about 125° C. to about 155° C.

In some embodiments, the crosslinked ionic fibrous material has a dry wrinkle recovery angle ranging from about 145 degrees to about 215 degrees. In some embodiments, the crosslinked ionic fibrous material has a wet wrinkle recovery angle ranging from about 130 degrees to about 250 degrees.

Unless otherwise defined, all technical and scientific terms used herein have the same meaning as commonly understood by one of ordinary skill in the art to which this presently described subject matter belongs. All publications, patent applications, patents, and other references mentioned herein are incorporated by reference in their entirety.

As used herein the term "alkali metal carbonate" refers to a molecule having the general formula $M_aCO_3$, wherein $M_a$ is an alkali metal, such as lithium, sodium, or potassium. An example of an alkali metal carbonate comprises sodium carbonate, abbreviated as $NaCO_3$.

The term "alkyl" refers to $C_{1-20}$ inclusive, linear (i.e., "straight-chain"), branched, or cyclic, saturated or at least partially and in some cases fully unsaturated (i.e., alkenyl and alkynyl) hydrocarbon chains, including for example, methyl, ethyl, propyl, isopropyl, butyl, isobutyl, tert-butyl, pentyl, hexyl, octyl, ethenyl, propenyl, butenyl, pentenyl, hexenyl, octenyl, butadienyl, propynyl, butynyl, pentynyl, hexynyl, heptynyl, and allenyl groups. "Lower alkyl" refers to an alkyl group having 1 to about 8 carbon atoms (i.e., a $C_{1-8}$ alkyl), e.g., 1, 2, 3, 4, 5, 6, 7, or 8 carbon atoms. In certain embodiments, "alkyl" refers, in particular, to $C_{1-8}$ straight-chain alkyls. In other embodiments, "alkyl" refers, in particular, to $C_{1-8}$ branched-chain alkyls.

Alkyl groups can optionally be substituted with one or more alkyl group substituents, which can be the same or different. The term "alkyl group substituent" includes but is not limited to alkyl, halo, arylamino, acyl, hydroxyl, aryloxyl, alkoxyl, alkylthio, arylthio, aralkyloxyl, aralkylthio, carboxyl, alkoxycarbonyl, oxo, and cycloalkyl. There can be optionally inserted along the alkyl chain one or more oxygen, sulfur or substituted or unsubstituted nitrogen atoms, wherein the nitrogen substituent is hydrogen, lower alkyl (also referred to herein as "alkylaminoalkyl"), or aryl.

The term "aryl" is used herein to refer to an aromatic substituent that can be a single aromatic ring, or multiple aromatic rings that are fused together, linked covalently, or linked to a common group such as a methylene or ethylene moiety. The common linking group also can be a carbonyl as in benzophenone or oxygen as in diphenylether or nitrogen as in diphenylamine. The term "aryl" specifically encompasses heterocyclic aromatic compounds. The aromatic ring(s) can comprise phenyl, naphthyl, biphenyl, diphenylether, diphenylamine and benzophenone, among others. In particular embodiments, the term "aryl" means a cyclic aromatic comprising about 5 to about 10 carbon atoms, e.g., 5, 6, 7, 8, 9, or 10 carbon atoms, and including 5- and 6-membered hydrocarbon and heterocyclic aromatic rings.

The aryl group can be optionally substituted with one or more aryl group substituents which can be the same or different, where "aryl group substituent" includes alkyl, aryl, aralkyl, hydroxyl, alkoxyl, aryloxyl, aralkyloxyl, carboxyl, acyl, halo, nitro, alkoxycarbonyl, aryloxycarbonyl, aralkoxycarbonyl, acyloxyl, acylamino, aroylamino, carbamoyl, alkylcarbamoyl, dialkylcarbamoyl, arylthio, alkylthio, alkylene, and —NR'R", where R' and R" can be each independently hydrogen, alkyl, aryl, and aralkyl.

Specific examples of aryl groups include but are not limited to cyclopentadienyl, phenyl, furan, thiophene, pyrrole, pyran, pyridine, imidazole, benzimidazole, isothiazole, isoxazole, pyrazole, pyrazine, triazine, pyrimidine, quinoline, isoquinoline, indole, carbazole, and the like.

As used herein, the terms "substituted alkyl" and "substituted aryl" include alkyl and aryl groups, as defined herein, in which one or more atoms or functional groups of the aryl or alkyl group are replaced with another atom or functional group, including for example, halogen, aryl, alkyl, alkoxyl, hydroxyl, nitro, amino, alkylamino, dialkylamino, sulfate, and mercapto.

The term "amino" refers to the —$NH_2$ group.

The term "anion" refers to a negatively charged ion. The term "polyanion" refers to a macromolecule comprising many negatively charged groups.

The term "cation" refers to a positively charged ion. The term "polycation" refers to a macromolecule comprising many positively charged groups.

The term "cellulose" or "cellulosic" refers to a complex polysaccharide molecule that is composed of linked cellobiose subunits, for example, disaccharide subunits comprising two D-glucopyranoses joined by a 1,4'-beta-glycoside bond, e.g., 4-β-D-glucopyranosyl-D-glucopyranose. Examples of a cellulosic material include, but are not limited to, cotton, flax, jute, hemp, ramie, and regenerated unsubstituted wood celluloses, such as rayon, tensel, lyocell, and the like. The term "alkali-cellulose" refers to the product of the interaction of an alkaline compound, such as sodium hydroxide, with purified cellulose.

The term "cellulosic material" refers to materials comprising cotton, linen, flax, viscose, cotton blends, such as cotton/polyester blends, and the like. The processes disclosed herein can be applied to cellulosic material in the form of woven material, non-woven sheets or webs or knit materials, to fibers, yarns, filaments, and to paper, felt, and the like.

The term "chitin" refers to a high molecular weight polysaccharide comprising beta-(1,4)-2-acetamido-2-deoxy-D-glucose. Chitin can be further described as a crosslinked polymer of N-acetyl-D-glucosamine.

The term "chitosan" refers to a high molecular weight linear polysaccharide comprising beta-(1,4)-2-amino-2-deoxy-D-glucose units (i.e., beta-1,4-poly-D-glucosamine). Raw chitosan comprises two hydroxyl groups per anhydroglucose monomer unit, i.e., one ring OH and one $C_6$ OH group per anhydroglucose unit, but only one $NH_2$ group. The term chitosan as used herein not only includes the natural polysaccharide beta-1,4-poly-D-glucosamine obtained by deacetylation of chitin or by direct isolation from natural products, such as fungi, but also includes synthetically produced beta-1,4-poly-D-glucosamines and derivatives thereof of equivalent structure to chitosan. A degree of deacetylation of 80% or more is preferred in the presently disclosed subject matter.

The term "crease-recovery" refers to the measure of crease-resistance specified quantitatively in terms of crease-recovery angle. See AATCC Standard Test Method 66-1990. Wrinkle Recovery of Fabrics: Recovery Angle Method.

The term "crease-resistance" refers to a term used to indicate resistance to, and/or recovery from, creasing of a textile material during use. This term also is referred to as "wrinkle resistance." The terms "crease-resistance" and "wrinkle resistance" include the terms "wet crease resistance," "dry crease resistance," "wet wrinkle recovery," and "dry wrinkle recovery." In some embodiments, the disclosed subject matter provides treatments which give recovery while the substrate is wet. In other embodiments, the disclosed subject matter provides treatments which give recovery while the substrate is dry.

The term "crosslinking" refers to the creation of chemical bonds, either ionic or covalent, between adjacent chains of a polymeric substance, e.g., a fiber, such as chitin, i.e., the acetylated naturally occurring from of chitosan.

The term "deacetylation" refers to a process by which an acetyl group (i.e., a group represented by the formula —C(═O)$CH_3$) is chemically removed from a fiber, such as cellulose.

The term "exhaust" refers to a process by which all of the reactive material, such as a dye, is used up by reacting with a substrate, such as a cellulosic material. The term "exhaustion" refers to a sorption process. In textile applications, exhaustion comprises the movement of a chemical species, e.g., a dye or a treatment chemical, such as a softener, into or onto a fibrous substrate. The chemical species can be completely exhausted, i.e., all on the substrate, or partially exhausted, i.e., partially sorbed. In a broader sense, the exhaustion could be from any fluid, not just a liquid. For example, it could be the sorption of a particular gas from a mixture of gases, or the sorption of a dye from a supercritical fluid, such as $CO_2$. Further, it is not necessary for the material to react for it to be exhausted. Exhaustion typically involves a physical affinity of the chemical species to the substrate due to hydrogen bonds, polar interactions, ionic interactions, and van der Waals or London forces.

The terms "halo", "halide", or "halogen" as used herein refer to fluoro, chloro, bromo, and iodo groups.

The term "hydroxyl" refers to the —OH group.

The term "mercerizing" refers to a treatment of a cellulosic material with an alkaline compound or mixture, such as 20% aqueous sodium hydroxide or anhydrous liquid ammonia, to make it more receptive to dyeing.

The term "metal alkyl" refers to a compound of the general formula $MR_n$, wherein M is a metal atom, including, but not limited to aluminum, boron, magnesium, zinc, gallium, indium, antimony and related metals, R is an alkyl group as defined herein, and n is an integer ranging from 1 to 4. A representative metal alkyl is trimethylaluminum, abbreviated as $Al(CH_3)_3$ or $AlMe_3$.

The term "natural fibrous material" refers to fibers naturally occurring in nature, such as cellulosic fibers, e.g., cotton, and wool.

The term "pad" is shorthand notation for padder and is often used in conjunction with other process terms to describe sequential operations in dyeing, or finishing, e.g., pad-bake, pad-batch, pad-dry, and pad-steam.

The term "padding" refers to the impregnation saturation of a substrate, such as a material, with a liquor or a paste, typically followed by expression squeezing to leave a specific quantity of liquor or paste on the substrate. Padding is typically performed at a saturation-expression to a controlled degree of wet pickup.

The term "pad-batch" refers to a process whereby a substrate, such as a material, is saturated by a padding process with a liquor comprising, for example, a reactive dye, salt, and alkaline compound. The substrate is then typically allowed to sit during a batching process in a sealed container for a predetermined time to react with the liquor.

The term "polyelectrolyte" refers to an electrolyte, such as a polysaccharide, which has a high molecular weight. A polyelectrolyte can be further described as an ion with multiple charged groups.

The term "polysaccharide" refers to any of a diverse class of high-molecular weight polymeric carbohydrates formed by the linking together by condensation of a monosaccharide or a monosaccharide derivative, units into linear or branched chains, and including homo-polysaccharides (composed of only one type of monosaccharide only) and hetero-polysaccharides. As used herein, the term "polysaccharide" comprises poly anhydroglucose or poly cellobiose compounds, such as in cotton and rayon, and poly deoxyaminoanhydroglucose compounds, such as in chitosan, and by analogy, chitin.

The term "protic acid" refers to a molecule which contains a hydrogen atom bonded to an electronegative atom, such as an oxygen atom or a nitrogen atom. Typical protic acids include, but are not limited to, carboxylic acids, such as acetic acid.

The term "saturated steam" refers to steam that is maintained at the same pressure as the vapor pressure of water at that temperature.

The term "scouring" refers to the removal of impurities from a material by washing with a detergent or other cleaning agent, such as a solvent.

The term "steeping" refers to the treatment of a textile material in a bath of liquid, typically, although not necessarily, without agitation. The term also is applied to processes whereby the materials are impregnated with a liquor, squeezed, and then allowed to sit for a period of time.

The term "sulfonate" refers to a derivative of a sulfur acid, having the general formula $R—S(O)_3^-M_a^+$, wherein R is an alkyl or aryl group or a substituted alkyl or substituted aryl group and $M_a$ is an alkali metal, such as lithium, sodium, or potassium.

The term "synthetic fibrous material" refers to man-made fibers, for example, polyester, nylon, and acrylic fibers.

The term "wet pickup" refers to the weight of solution divided by the weight of dry substrate before padding. In a padding process, a material is typically saturated by dipping it in the solution, then the liquid is expressed to achieve a specific desired wet pickup.

Throughout the specification and claims, a given chemical formula or name shall encompass all optical and stereoisomers, as well as racemic mixtures where such isomers and mixtures exist.

EXAMPLES

The following Examples have been included to illustrate representative embodiments of the presently disclosed subject matter. Certain aspects of the following Examples are described in terms of techniques and procedures found or contemplated to work well in the practice of presently disclosed subject matter. In light of the present disclosure and the general level of skill in the art, those of skill will appreciate that the following Examples are intended to be exemplary only and that numerous changes, modifications, and alterations can be employed without departing from the spirit and scope of the presently disclosed subject matter.

Materials

The following chemical reactants and materials were used in the Examples: chloroacetic acid (CAA) (reagent grade, Fischer Chemicals, Fairlawn, N.J., United States of America); 2-chloroethyl sulfonic acid (reagent grade, Fischer Chemicals, Fairlawn, N.J., United States of America); 3-chloro-2-hydroxypropyl trimethyl ammonium chloride (CHTAC) (Dow CR2000, 69% CHTAC solution (The Dow Chemical Company, Midland, Mich., United States of America)); Chitosan (85% N-deacetylated chitin (Vanson Chemicals, Redmond, Wash., United States of America)); and cotton fabric (scoured and bleached plain weave, 114 g/m$^2$ (Testfabrics, Inc., Pittson, Pa., United States of America)). A standard laboratory padder, steamer, curing oven, etc., were used.

Analysis

Nitrogen analysis was accomplished using a Leuco HCN analyzer. The percent nitrogen content was used as an indicator of the amount of CHTAC that reacted with the cellulose.

Carboxymethyl content of cellulosic fabric was determined as follows. Samples were steeped in a 0.1% HCl solution at room temperature overnight. These samples were then washed with distilled water until the wash water showed no presence of chloride by $AgNO_3$ drop test. Samples were dried at 105° C., then brought to standard conditions. Exactly 0.3 g of each sample was carefully weighed and combined with 100 mL distilled water and 20 mL of 0.05 N NaOH in a beaker. This mixture was titrated with standardized HCl solution to a phenolphthalein end point. The carboxymethyl content was calculated as follows:

$$\text{mmols carboxymethyl content per 100 grams}=100\times(V_o-V)\times(N_{HCl})/(0.3)$$

wherein V is the titer for the sample, $V_o$ is the titer for the blank, and $N_{HCl}$ is the normality of the HCl titrant.

Crease angle measurements were made by using the American Association of Textile Chemists and Colorists (AATCC) Standard Test Method 66, Wrinkle Recovery of Fabrics: Recovery Angle Method. Breaking strength was determined with an Instron tensile tester using American Society for Testing and Materials (ASTM) test method D1682.

Example 1

Cationized Chitosan Treatment of Cellulosic Fabric

Ionic crosslinked cellulosic fabric was produced in three steps. First, a polycation was synthesized using chitosan and CHTAC. Second, cellulosic fabric was carboxymethylated using CAA, which provided a reactive anion. Finally, the polycation was padded or exhausted on to the pretreated fabric. The degree of carboxymethylation of the cellulose was determined by titration, and the amount of cationized chitosan (CC) sorbed was determined by elemental analysis for nitrogen. Seventy samples were produced with various degrees of carboxymethylation and various pad bath concentrations of CC. Only one level of cationization of chitosan was used.

Highly cationic chitosan was produced by the reaction of 85% N-deacetylated chitin with CHTAC. 161 g of 85% N-deacetylated chitin was slurried in 1156 g of 69% w/w solution of CHTAC. NaOH (50% w/w) was added dropwise to maintain a pH of 10 to 11. The slurry was stirred overnight, then the temperature was raised to 95° C. for 4 hours (h), then cooled to room temperature and adjusted to pH 7 with acetic acid. The resulting reaction product was soluble in the reaction mixture. When recovered by drying, the resulting product was redissolved in room temperature water at pH 7.

Anionic cellulose was produced with varying carboxymethyl content (up to 125 mmol per 100 g). Bleached cellulosic fabric was impregnated with 20% aqueous NaOH for 10 minutes (min) at room temperature followed by squeezing to a wet pick up of 100%. Samples were dried at 60° C. These alkali-treated samples were then steeped for 5 min at room temperature in aqueous solutions of CAA that had been neutralized with sodium carbonate at various concentrations (0 to 3.0M). These samples were then squeezed to 100% wet pickup, sealed in plastic bags and heated at 70° C. for 1 h. Samples were then washed and dried at room temperature. Blanks were included. This process produced seven different levels of carboxymethylation, e.g., 6.15, 30.2, 60.7, 87.1, 97.3, 114.5, and 123.7 mmols of carboxymethyl groups per 100 grams of fabric, as determined by titration.

The CC was applied to the carboxymethylated cellulosic fabric by padding through solutions of CC in water at 100% wet pickup, then drying at 105° C. Various concentrations of CC were used in the padding bath, e.g., 0.0, 0.5, 2, 4, and 6% solution concentration. The wrinkle recovery angle (WRA), nitrogen content, and strength data for fabric samples treated by this Example are shown in Tables 1, 2, and 3, respectively.

TABLE 1

Dry and wet wrinkle recovery angles for treated fabrics (dry/wet).

| | CC treatment > pad bath conc. | | | | |
|---|---|---|---|---|---|
| COOH$^-$content | 0%, blank | 0.5% | 2% | 4% | 6% |
| 6.2 | 140/130 | 145/200 | 180/250 | 156/200 | 140/260 |
| 30.2 | 145/135 | 156/208 | 188/206 | 172/250 | 164/264 |
| 60.7 | 140/144 | 154/204 | 162/200 | 190/252 | 160/274 |
| 87.1 | 142/150 | 162/200 | 172/200 | 166/250 | 180/295 |
| 97.3 | 145/148 | 158/200 | 162/230 | 174/272 | 180/295 |
| 114.5 | 145/140 | 154/226 | 160/256 | 178/284 | 184/320 |
| 123.7 | 148/130 | 156/224 | 166/286 | 180/298 | 192/326 |

TABLE 2

Nitrogen content for treated fabrics (% nitrogen).

| COOH$^-$ | CC treatment > pad bath conc. | | | | |
|---|---|---|---|---|---|
| content | 0%, blank | 0.5% | 2% | 4% | 6% |
| 6.2 | 0% | 0.015% | 0.021% | 0.072% | 0.19% |
| 30.2 | 0% | 0.07% | 0.21% | 0.26% | 0.31% |
| 60.7 | 0% | 0.16% | 0.30% | 0.38% | 0.42% |
| 87.1 | 0% | 0.25% | 0.31% | 0.38% | 0.47% |
| 97.3 | 0% | 0.33% | 0.39% | 0.48% | 0.49% |
| 114.5 | 0% | 0.33% | 0.39% | 0.49% | 0.51% |
| 123.7 | 0% | 0.36% | 0.41% | 0.49% | 0.52% |

TABLE 3

Breaking strength of treated fabrics (N).

| | CC treatment > pad bath conc | | | | |
|---|---|---|---|---|---|
| COOH-Content | 0%, Blank | 0.5% | 2% | 4% | 6% |
| 6.2 | 143 | 145 | 147 | 156 | 156 |
| 30.2 | 143 | 148 | 151 | 159 | 166 |
| 60.7 | 147 | 136 | 115 | 144 | 166 |
| 87.1 | 141 | 149 | 155 | 164 | 168 |
| 97.3 | 136 | 137 | 148 | 154 | 169 |
| 114.5 | 134 | 138 | 148 | 155 | 170 |
| 123.7 | 123 | 130 | 153 | 158 | 174 |

The ionic crosslinking treatments described in this Example produced significant WRA improvements, without significant strength loss, as shown in FIGS. 1*a*–1*c*.

Nitrogen analysis of laundered fabric samples treated as described in this Example showed that the CC finish was durable to laundering. The nitrogen content of the treated fabric samples initially was 0.453%; after one home laundering, 0.452%; after two home launderings, 0.453%; and after three home launderings, 0.451%.

Example 2

Simultaneous and Sequential Pad-Batch Treatments of Cellulosic Fabric

Forty-three specimens of cellulosic fabric were treated with reactive anionic fabric (e.g., CAA or CMSA) and cationizing agent (e.g., CHTAC). These treatments were performed in two ways—either simultaneously or sequentially. Simultaneous treatment involved padding previously untreated fabric through a solution of CHTAC and the reactive anion in the same bath. Sequential treatment involved making previously untreated fabric anionic, then subsequently treating it with CHTAC. In each case, CHTAC levels of 0, 25, 50, and 100 g/L (of 69% solution) were used. For CAA, the treatment levels were 0, 70.8 g/L (0.75 M), 141.7 g/L (1.5M), and 284.5 g/L (3.0 M). For CMSA, the treatment levels were 0, 10, 30, and 60 g/L.

Anionic treatments for sequential treatment were carried out by the same process described above in Example 1. Cationic treatments and simultaneous treatments were done by a pad-batch procedure as follows. CHTAC (or CHTAC and CAA adduct) was mixed in solution with sodium hydroxide at a 1:2.2 mol ratio (CHTAC:NaOH) to produce EPTAC in solution.

TABLE 4a

Wrinkle recovery angle using chloroacetic acid (dry/wet) - simultaneous treatment.

| CHTAC | Chloroacetic acid, g/L | | | |
|---|---|---|---|---|
| 69% sol'n | 0 g/L | 70.8 g/L | 141.7 g/L | 283.5 g/L |
| 0 g/L | 135/110 | 145/130 | 150/160 | 150/175 |
| 25 g/L | 170/130 | 180/230 | 220/240 | 215/240 |
| 50 g/L | 180/140 | 200/240 | 230/260 | 210/250 |
| 100 g/L | 190/150 | 220/230 | 245/230 | 255/225 |

TABLE 4b

Wrinkle recovery angle using chloroacetic acid (dry/wet) - sequential treatment.

| CHTAC | Chloroacetic acid, g/L | | | |
|---|---|---|---|---|
| 69% sol'n | 0 g/L | 70.8 g/L | 141.7 g/L | 283.5 g/L |
| 0 g/L | 135/110 | 145/130 | 150/160 | 150/170 |
| 25 g/L | 170/130 | 160/250 | 180/230 | 185/240 |
| 50 g/L | 180/140 | 220/230 | 235/240 | 200/225 |
| 100 g/L | 190/150 | 190/210 | 210/230 | 240/225 |

TABLE 5

Wrinkle recovery angle using 2-chloroethyl sulfonic acid (dry/wet).

| | 2-Chloroethyl sulfonic acid, g/L, simultaneous treatment | | | | 2-Chloroethyl sulfonic acid, g/L, sequential treatment | | | |
|---|---|---|---|---|---|---|---|---|
| CHTAC 69% sol'n | 0 g/L | 10 g/L | 30 g/L | 60 g/L | 0 g/L | 10 g/L | 30 g/L | 60 g/L |
| 0 g/L | 135/110 | 140/130 | 150/130 | 155/140 | 135/110 | 140/130 | 150/130 | 155/140 |
| 25 g/L | 170/130 | 220/175 | 235/180 | 210/205 | 170/130 | 210/180 | 240/210 | 250/230 |
| 50 g/L | 180/140 | 215/185 | 220/195 | 215/225 | 180/140 | 220/235 | 230/260 | 250/250 |
| 100 g/L | 190/155 | 240/200 | 260/230 | 280/235 | 190/150 | 250/280 | 255/285 | 265/280 |

Cellulosic fabric was padded through this mix, then batched overnight at room temperature in a plastic bag. The degree of fixation in this case is typically about 40% to 50%.

The treated fabrics were evaluated for nitrogen content, tensile strength, and wet and dry WRA. As shown in Tables 4(a,b) and 5, significant gains in WRA were observed. As shown in Table 5, treatments with CMSA generally are more effective if performed sequentially. There is little difference, however, between simultaneous and sequential treatments with CAA, although the simultaneous treatment process seems to give a few slightly higher WRA values (see Table 5).

The precision of the AATCC Standard Test Method 66, Wrinkle Recovery of Fabrics: Recovery Angle Method for an individual measurement is about 2.5 degrees. On average, the difference between untreated controls and fully treated samples in this study is 130 degrees, which represents a significant increase. Wet WRA vs. nitrogen data have a coefficient of determination ($r^2$) of 0.74 for fitting 70 samples with a two-parameter model, which yields an F statistic of 190. This improvement of WRA is highly correlated with the treatment.

Strength testing for the 43 treated samples showed tensile strength increases of up to 60%. Only 2 of the 43 samples showed strength loss (of 5% and 16%). Three-fourths of the treated samples showed a tensile strength gain greater than 10%.

Examples 3–6

Processes for Producing Cationic Cellulose

Approximately 180 cationizing-agent treated cellulose samples were produced by different application and pretreatment processes using pretreatment, pad-batch, pad-steam, exhaust application, pad-dry-cure, and non-aqueous solvents. In each case, parameters of the process, e.g., concentration, time, temperature, additives, and the sequence of events, were varied. In each case, samples were thoroughly washed after treatment to remove unfixed fabric, then analyzed for percent nitrogen content using a Leuco HCN analyzer as an indicator of the amount of CHTAC, the cationizing agent that was used to treat the samples, that reacted with the cellulose.

For the purposes of the presently disclosed subject matter, reaction efficiency is defined as $$E=(\text{amount of CHTAC fixed})/(\text{amount of CHTAC hydrolyzed}) \quad (1)$$

or $$E=(m_c V^c \Delta t)/(m_s V^s \Delta t) \quad (2)$$

wherein $m_c$ is the mass of cellulose in the system, $V^c$ is the reaction velocity for CHTAC fixation in the cellulose, $\Delta t$ is the time increment of the reaction, $m_s$ is the mass of solution, and $V^s$ is the CHTAC hydrolysis reaction velocity.

Equation 2 can be rewritten as $$E=(1/L)(V^c/V^s) \quad (3)$$

wherein L is the bath ratio—that is, the ratio of the mass of treatment solution to mass of cellulose being treated. The kinetic rate laws for these processes are $$V^c=dc^c/dt=-k_f(c^c)^n[\text{CellO}^-]^m \quad (4)$$

$$V^s=dc^s/dt=-k_h(c^s)^n[\text{OH}^-]^m \quad (5)$$

wherein $k_f$ is the fixation rate constant, $k_h$ is the hydrolysis rate constant, $c^c$ and $c^s$ are the concentrations of unreacted CHTAC in the cellulose and the solution, respectively, and n and m are the reaction orders with respect to EPTAC and the nucleophilic agent, respectively.

For the purposes of the presently disclosed subject matter, the orders of the reactions with water and with cellulose are assumed to be the same, but the qualitative purposes of this analysis hold even if the orders are different. Combining Equation 5 with Equation 3 gives $$E=(1/L)(k_f(c^c)^n[\text{CellO}^-]^m)/(k_h(c^s)^n[\text{OH}^-]^m) \quad (6)$$

or, upon rearranging $$E=(1/L)(k_f/k_h)(c^c/c^s)^n([\text{CellO}^-]/[\text{OH}^-])^m \quad (7)$$

$$E=(RK^n/L)([\text{CellO}^-]/[\text{OH}^-]^m \quad (8)$$

wherein R is the ratio of rate constants, K is the partition coefficient, and $[\text{CellO}^-]/[\text{OH}^-]$ is the ratio of concentrations of ionized cellulose to hydroxyl ions.

Equation 8 identifies potentially important parameters that control fixation. These parameters include R, the ratio of rate constants for fixation and hydrolysis; K, the partition coefficient, which depends on the affinity; and L, the bath ratio. The value of [CellO—]/[OH—] is known to be fairly constant at a value of 30 over a wide range of pH values. See Procion Dyestuffs in Textile Dyeing, 21 (Arnold, Hoffman & Co. Incorporated, Providence, R.I., United States of America (1962)). The values of m and n are unknown, but they are constants that are not within the control of the processor, so the lack of knowledge of their specific values does not impair this analysis.

The rate constants for hydrolysis and fixation are both temperature-dependent, and the cellulose rate constant might be affected by pretreatments (e.g., mercerization) prior to the reaction. Changing the temperature changes the reaction rate ratio if, for example, the activation energies are different for Reactions II and III as shown in Scheme 1. Mercerization with caustic or ammonia (or other treatments) can produce cellulose of different morphology and crystallinity, which in turn is expected to affect $k_f$. See Cuculo, J. A., et al., J. Polymer Sci.: Part A: Polymer Chemistry, 22, 229–239 (1994). In addition, the type of alkali used in the reaction might affect $k_h$.

The partition of EPTAC between the cellulose fiber and water directly affects the fixation efficiency. Increasing the exhaustion of EPTAC onto cellulose, thereby increasing K, improves fixation efficiency. The presently disclosed subject matter provides processes that use additives (e.g., salt) in the processing bath and/or changing temperature and/or pH to improve the fixation efficiency. Representative process embodiments are provided with the following Examples 3–6. The role of these factors in cationization is different than that in dyeing, however. Salt, for example, is used in dyeing to enhance exhaustion by offsetting the negative zeta potential of cellulose in water, decreasing solubility of the anionic dye in water, and disrupting hydration of dyeing sites. Since CHTAC and EPTAC are cationic, it is not necessarily desirable to offset the negative zeta potential of the cellulose.

The bath ratio can be reduced in exhaust processes by using less water per amount of cellulose. In addition, the amount of water available for reaction can be limited in other ways, such as using pad-batch or pad-steam processes, or using solvents other than water—in particular, solvents that cannot ionize to form strongly nucleophilic moieties that might react with EPTAC.

In addition to reducing the availability of water in the system, it is possible to essentially eliminate water as a reactant altogether by using pad-dry-cure processes in which the temperature is kept low when water is present, then elevated only after the water is removed.

Examples 3–6 provide characteristics of R, the rate constant ratio; L, the bath ratio; and K, the partition coefficient in pad-batch processes, exhaust processes, pad-steam processes, and pad-dry-cure processes.

Example 3

Pad-Batch CHTAC Process

Fabrics were padded at 100% wet pickup, then stored in airtight plastic bags for 24 h at room temperature. Three sets of experiments were done using the pad-batch process to investigate the effect of pretreatment, additives, concentration of CHTAC, and sequence of events.

Table 6 shows the effects of various padding sequences, with the percent nitrogen fixed in each case. Each sample in Table 6 was treated by the pad-batch process with 86.25 g/L CHTAC (125 g/L of a CHTAC product that is 69% solids) and NaOH as indicated. These chemicals were padded in various sequences as indicated in Table 6. All sequence padding was wet-on-wet except Sample 3, which was dried between the first and second paddings. The EPTAC solution used in Sample 3 was made by adding 20.2 g/L NaOH to the 86.25 g/L CHTAC solution.

TABLE 6

Pad-batch Sequences

| Sample | First solution | Second solution | % N |
|---|---|---|---|
| 0 | None (control) | None (control | nil |
| 1 | CHTAC and NaOH (41.2 g/L) | None | 0.160 |
| 2 | CHTAC, then dry at 50° C. | NaOH (41.2 g/L) | 0.041 |
| 3 | EPTAC (CHTAC + 20.2 g/L NaOH) | NaOH (14.7 g/L) | 0.151 |
| 4 | NaOH (41.2 g/L) | CHTAC | 0.020 |
| 5 | NaOH (14.7 g/L) | EPTAC (CHTAC + 20.2 g/L NaOH) | 0.189 |

Table 7 shows effects of various additives, with the percent nitrogen fixed in each case. Each sample in Table 7 was padded at 100% wet pickup with a solution of 86.25 g/L CHTAC and 41.2 g/L NaOH, plus various additives as indicated. The control for this series was Sample #1 in Table 6. Additives were selected according to their perceived potential to interact with the CHTAC (or EPTAC) in solution, to cause CHTAC (or EPTAC) to precipitate onto the fabric, or to participate in the fixation reaction.

TABLE 7

Pad-batch Additives

| Sample | Additive | Concentration | % N |
|---|---|---|---|
| 0 | No additive (control) | Nil | 0.160 |
| 1 | Sodium lauryl sulfate | 50 g/L | 0.212 |
| 2 | Sodium lauryl sulfate | 20 g/L | 0.046 |
| 3 | Sodium lauryl sulfate | 10 g/L | 0.032 |
| 4 | Sodium lauryl sulfate | 5 g/L | 0.029 |
| 5 | Triethanol amine | 5 g/L | 0.150 |
| 6 | Triethanol amine | 1 g/L | 0.220 |
| 7 | Ethylenediamine tetraacetic acid | 30 g/L | 0.185 |
| 8 | Butane tetracarboxylic acid | 30 g/L | 0.155 |
| 9 | Sodium thiosulfate | 30 g/L | 0.021 |
| 10 | Sodium tetraborate | 30 g/L | 0.080 |
| 11 | Sodium chloride | 30 g/L | 0.240 |
| 12 | Guanidine | 30 g/L | 0.215 |
| 13 | Diethylamine | 30 g/L | 0.171 |
| 14 | Epichlorohydrin | 5 g/L | 0.251 |
| 15 | Epichlorohydrin | 15 g/L | 0.231 |
| 16 | Epichlorohydrin | 30 g/L | 0.223 |

The effect of varying CHTAC and NaOH concentration in the pad-batch process is shown in Table 8. In every case, the molar amount of NaOH is 2.25 times he molar amount of CHTAC. The control for this series is Sample #1 in Table 6.

TABLE 8

Effect of CHTAC and NaOH concentration

| Sample | CHTAC g/L | NaOH g/L | % N |
|---|---|---|---|
| 1 | 0.69 | 0.33 | 0.034 |
| 2 | 1.38 | 0.66 | 0.035 |
| 3 | 3.45 | 1.65 | 0.038 |
| 4 | 6.90 | 3.30 | 0.044 |
| 5 | 17.2 | 8.25 | 0.070 |
| 6 | 34.5 | 16.50 | 0.072 |

TABLE 8-continued

Effect of CHTAC and NaOH concentration

| Sample | CHTAC g/L | NaOH g/L | % N |
|---|---|---|---|
| 7 | 51.8 | 24.75 | 0.096 |
| 8 | 69.0 | 33.00 | 0.118 |
| 9 | 86.2 | 41.25 | 0.162 |
| 10 | 103.5 | 49.50 | 0.198 |
| 11 | 135.0 | 66.00 | 0.260 |

Samples were treated by the pad-batch process after pretreatments with various processing solutions as listed in Table 9. After pretreatment, each sample was subsequently padded at 100% wet pickup with a solution of 103.5 g/L of CHTAC and 41.25 g/L NaOH. Each sample was pretreated by soaking it in the pretreatment solution for 5 min without tension at room temperature, unless otherwise stated. Pretreatment solutions were removed from samples by various processes prior to treatment with CHTAC, including washing with room-temperature water or evaporation of the pretreatment solution at room temperature. The percent fixation for pad-batch samples is given in Table 10.

TABLE 9

Pretreatment

| Sample | Pretreatment (concentrations are w/w) | Removal method | % N |
|---|---|---|---|
| 0 | Control (no pretreatment) | Control (no pretreatment) | 0.230 |
| 1 | 25% guanidine solution | Wash with water | 0.190 |
| 2 | 25% guanidine solution | Dry by room temperature evaporation | 0.150 |
| 3 | 25% sodium hydroxide | Wash with water | 0.193 |
| 4 | 25% sodium hydroxide | Wash with 5% guanidine solution | 0.220 |
| 5 | 25% potassium hydroxide | Wash with room temperature water | 0.170 |
| 6 | 25% potassium hydroxide | Wash with 5% guanidine solution | 0.177 |
| 7 | 5% trimethylammonium hydroxide | Wash with water | 0.120 |
| 8 | 5% trimethylammonium hydroxide | Wash with 5% guanidine solution | 0.137 |
| 9 | 25% trimethylammonium hydroxide | Wash with water | 0.144 |
| 10 | 25% trimethylammonium hydroxide | Wash with 5% guanidine solution | 0.142 |
| 11 | 30% aqueous ammonia | Wash with water | 0.140 |
| 12 | 30% aqueous ammonia | Wash with 5% guanidine solution | 0.143 |
| 13 | Liquid ammonia at −78° C. | Drying by evaporation | 0.177 |
| 14 | Liquid ammonia at −78° C. | Wash with 5% guanidine solution | 0.136 |
| 15 | Liquid ammonia at −78° C. | Wash with water | 0.155 |
| 16 | Treatment 3 followed by 15 | Wash with water (as in 3 and 15) | 0.146 |
| 17 | Treatment 15 followed by 3 | Wash with water (as in 3 and 15) | 0.176 |

TABLE 10

Percent Fixation for Pad-Batch Samples

| Sample | Table 6 0.642% applied Sequences Max error = 3.1% | Table 7 0.642% applied Additives Max error = 3.1% | Table 8 Applied varies Concentration Max error (*) | Table 9 0.707% applied Pretreatment Max error = 2.8% |
|---|---|---|---|---|
| 0 | | 24.9% | | 32.5% |
| 1 | 24.9% | 33.0% | 66.2% (38.9%) | 26.9% |
| 2 | 6.4% | 7.2% | 34.1% (19.5%) | 21.2% |
| 3 | 23.5% | 5.0% | 14.8% (7.8%) | 27.3% |
| 4 | 3.1% | 4.5% | 8.6% (4.0%) | 31.1% |
| 5 | 29.4% | 23.4% | 5.4% (1.6%) | 24.0% |
| 6 | | 34.3% | 2.8% (0.8%) | 25.0% |
| 7 | | 28.8% | 2.5% (0.5%) | 17.0% |
| 8 | | 24.1% | 2.3% (0.4%) | 19.4% |
| 9 | | 3.3% | 2.5% (0.3%) | 20.4% |
| 10 | | 12.5% | 2.6% (0.3%) | 20.1% |
| 11 | | 37.4% | 2.5% (0.2%) | 19.8% |
| 12 | | 33.5% | | 20.2% |
| 13 | | 26.6% | | 25.0% |
| 14 | | 39.1% | | 19.2% |
| 15 | | 36.0% | | 21.9% |
| 16 | | 34.7% | | 20.7% |
| 17 | | | | 24.9% |

*Since the amount applied is different for each sample in this column, the accuracy varies. The number in parenthesis for Table 8 data is the maximum absolute error of the value. In each case, the error, if any, is expected to be a bias toward higher values.

Overall, the pad-batch process produces at best slightly less than 40% fixation. At very low concentrations, the fixation is higher. The treatments at very low concentrations, however, produce such a low degree of cationization (0.034% nitrogen fixed, or about 2.5 mmol of cationic sites per 100 g of cellulose) that it is of little use commercially. This observation does not suggest, however, that multiple treatments with low levels of CHTAC might be more efficient than that of a single treatment at high concentration.

Fixation derived from the data in Table 6 shows that the most effective sequence is a two-stage padding process in which the fabric first is padded through NaOH, then through EPTAC solution. This process is slightly better than a more simple one-stage padding in which the NaOH and CHTAC are combined in one bath.

Fixation derived from the data in Table 7 shows that the addition of very large amounts of sodium lauryl sulfate can increase fixation slightly, presumable because they complex with the CHTAC or EPTAC in solution and promote exhaustion (or precipitation) onto the cellulose. The addition of triethanolamine, butane tetracarboxylic acid, ethylenediamine tetraacetic acid, or diethylamine provides at best modest improvement in the fixation. Sodium thiosulfate or tetraborate seem to suppress fixation. Salt, guanidine, and epichlorohydrin are the most effective additives, and can raise the fixation from about 25% (control) into the 30% to 40% range.

Figure 2:
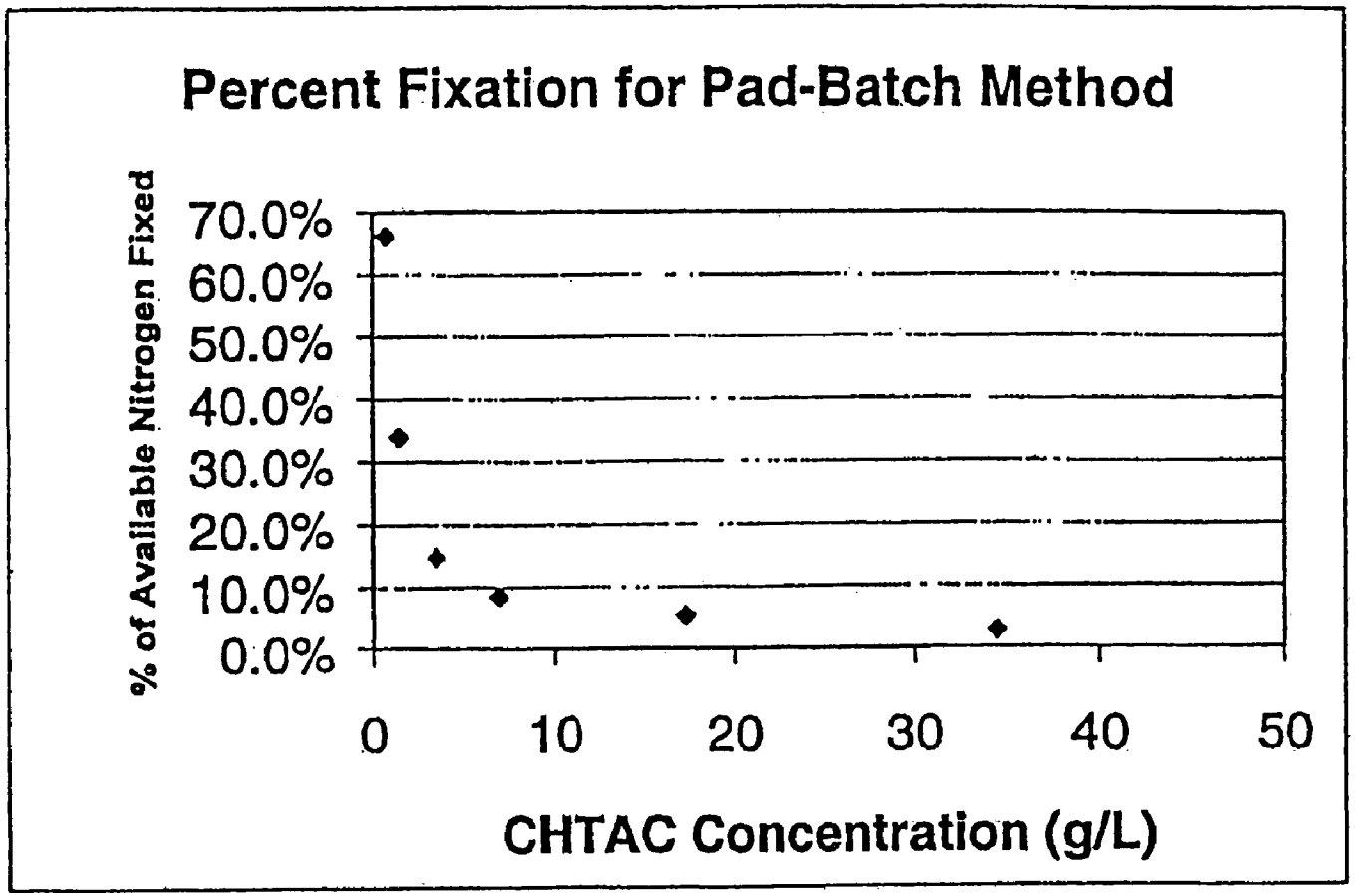
FIG. 2 shows the percent fixation for the pad-batch application process described in Example 2.

Fixation derived from the data in Table 8 shows a clear trend in which the fixation decreases with increasing CHTAC concentration. This trend is shown in FIG. 2.

Fixation derived from the data in Table 9 shows that the use of pretreatment is not effective and usually results in a decrease in fixation, possibly due to the general tendency for such treatments to increase the crystallinity of cellulose. See Cuculo, J. A., et al., J. Polymer Sci.: Part A: Polymer Chemistry, 22, 229–239 (1994).

Example 4

Exhaust Process

CHTAC was applied to cellulosic fabric by exhaustion in four series of experiments in which the effects of concentration, additives, use of non-aqueous solvents and the variation of the sequence of events were investigated. Preliminary screening studies identified the optimum exhaustion process time and temperature as 1.5 h at 75° C. All exhaustion was done at 20:1 bath ratio, using nominally 10 g of fabric.

A series of five exhaustion experiments was performed to investigate the effects of the sequence of events. In these experiments, all treatments except those in experiment #5 were done using 6.9 g/L CHTAC (13.8% on weight of goods) and 3.25 g/L NaOH (6.5% on weight of goods, or 2.2 times the mols of CHTAC). In experiment #5, the amount of NaOH initially added was 1.46 g/L, which represents a 1:1 mol ratio with the CHTAC. The various sequences and resulting nitrogen fixation are shown in Table 11.

TABLE 11

Effects Sequence of Events on Fixation

| Sample | Sequence | % N |
|---|---|---|
| 1 | Add CHTAC and NaOH, wait 5 minutes, add fabric, run 90 minutes | 0.055 |
| 2 | Add CHTAC and NaOH, wait 10 minutes, add fabric, run 90 minutes | 0.045 |
| 3 | Add fabric and CHTAC, then add NaOH dropwise, run 90 minutes | 0.045 |
| 4 | Add fabric and NaOH, then add CHTAC dropwise, run 90 minutes | 0.039 |
| 5 | Add CHTAC and NaOH, then add fabric and 10 g/L $Na_2CO_3$ | 0.009 |

A series of twelve exhaustion experiments was performed to investigate the effects of concentration. In these experiments, all treatments were done by adding the CHTAC and NaOH to the bath, then introducing the fabric. The various concentrations and resulting nitrogen fixations are shown in Table 12.

A series of seven exhaust experiments was done with 34.5 g/L CHTAC and 16.25 g/L NaOH to evaluate the effects of various additives on the exhaust fixation process. The no-additive control for this series is Application #5 in Table 12.

TABLE 12

Exhaustion with Various Concentrations of CHTAC and NaOH

| Sample | CHTAC g/L | NaOH g/L | Mol ratio NaOH:CHTAC | % N |
|---|---|---|---|---|
| 1 | 1.38 | 0.650 | 2.20:1 | 0.021 |
| 2 | 3.45 | 1.625 | 2.20:1 | 0.022 |
| 3 | 4.83 | 2.275 | 2.20:1 | 0.027 |
| 4 | 6.90 | 3.520 | 2.20:1 | 0.058 |
| 5 | 34.5 | 16.25 | 2.20:1 | 0.135 |
| 6 | 1.38 | 3.250 | 11.06:1 | 0.020 |
| 7 | 3.45 | 3.250 | 4.43:1 | 0.036 |
| 8 | 4.83 | 3.250 | 3.16:1 | 0.040 |
| 9 | 6.90 | 3.250 | 2.21:1 | 0.049 |
| 10 | 6.90 | 3.250 | 1.53:1 | 0.020 |
| 11 | 6.90 | 1.500 | 1.02:1 | 0.005 |
| 12 | 6.90 | 0.750 | 0.51:1 | 0.005 |

The additives, concentrations and the resulting percent nitrogen fixation are shown in Table 13.

TABLE 13

Additives in the Exhaustion Process

| Sample | Additive | Concentration g/L | % N |
|---|---|---|---|
| 1 | pH 12 buffer-NaOH/$Na_2CO_3$ | 10 g/L | 0.121 |
| 2 | pH 12 buffer-NaOH/$Na_2CO_3$ | 30 g/L | 0.088 |
| 3 | Triethanol amine | 5 g/L | 0.153 |
| 4 | Sodium chloride | 30 g/L | 0.147 |
| 5 | Sodium lauryl sulfate | 30 g/L | 0.144 |
| 6 | Ethylenediamine tetraacetic acid | 30 g/L | 0.140 |
| 7 | Epichlorohydrin | 5 g/L | 0.179 |

Finally, a series of five exhaust applications was done from various solvents as shown in Table 14. In these exhaustion experiments, the concentration of CHTAC was 6.9 g/L, and the concentration of NaOH was 3.25 g/L. Since the CHTAC was supplied as a 69% aqueous solution, 3.1 g/L water was present in all treatments. Each treatment was done at 70° C. for 90 min at a bath ratio of 20:1. The control for this series of experiments is Sample #1 in Table 11.

TABLE 14

Effect of Solvent Selection

| Sample | Solvent | % N |
|---|---|---|
| 1 | Water (control) | 0.055 |
| 2 | Acetone | 0.339 |
| 3 | Ethanol | 0.037 |
| 4 | Isopropanol | 0.005 |
| 5 | Methanol | 0.028 |

The percent fixation for samples treated by the exhaust process is shown in Table 15.

TABLE 15

Percent Fixation for the Exhaust Method

| Sample | Table 11 1.027% supplied Sequences Max error = 1.9% | Table 12 supplied varies Concentration Max error (*) | Table 13 5.138% supplied Additive Max error = 0.4% | Table 14 1.027% supplied Solvent Max error = 1.9% |
|---|---|---|---|---|
| 1 | 5.4% | 10.2% (9.7%) | 2.4% | 5.4% |
| 2 | 4.4% | 4.3% (3.9%) | 1.7% | 33.0% |
| 3 | 4.4% | 3.8% (2.8%) | 3.0% | 3.6% |
| 4 | 3.8% | 5.6% (1.9%) | 2.9% | 0.5% |
| 5 | 0.9% | 2.6% (0.4%) | 2.8% | 2.7% |
| 6 | | 9.7% (9.7%) | 2.7% | |
| 7 | | 7.0% (2.8%) | 3.5% | |
| 8 | | 5.6% (1.9%) | | |
| 9 | | 4.8% (1.9%) | | |
| 10 | | 1.9% (1.9%) | | |
| 11 | | 0.5% (1.9%) | | |
| 12 | | 0.5% (1.9%) | | |

The data from Tables 11, 12, and 13 are all based on aqueous baths, in which the fixation for the exhaust process is typically 5% or less. The amount of nitrogen applied in these experiments was quite high (several percent on weight of goods) due to the 20:1 bath ratio. These values are, in some cases, so low that they are comparable to the absolute error in the analysis method.

The data in the last column (fixation from experiments of Table 14) show a notably high value of 33% for the exhaust application from acetone, a solvent that does not ionize under these conditions to form a nucleophile capable of reacting with EPTAC.

Example 5

Pad-Steam

Two samples were treated by pad-steam processes in which a fabric sample was padded through a solution of 34.5 g/L CHTAC and 16.25 g/L NaOH. One sample was dried at 40° C. and the other was not dried. Then both samples were exposed to saturated steam at 100° C. for 30 min. Nitrogen fixation was 0.130% for the dried sample, and 0.071% for the sample that was not dried.

The two samples that were processed by the pad-steam process had fixation of 50.6% (dried sample) and 27.6% (not dried). The maximum error in each case was 7.8%. The drying apparently removed much of the available water and thereby decreased the fraction of the applied CHTAC that hydrolyzed.

Example 6

Pad-dry-cure

Several series of treatments were done by the pad-dry-cure process. These treatments included investigations of the effects of drying time and temperature, curing time and temperature, CHTAC:NaOH mol ratio, CHTAC concentration, and various additives. In each case, the fabric was padded through a solution of CHTAC and NaOH, then dried at a low temperature, and finally cured at a higher temperature.

In one series of experiments, fabrics were padded at 100% wet pickup through a solution of 69 g/L CHTAC and 32.5 g/L NaOH. The fabrics were dried at various times and temperatures, and then cured at 115° C. for 4 min. The times, temperatures, and percent nitrogen fixation are shown in Table 16.

TABLE 16

Percent Nitrogen Fixed at Various Drying Times and Temperatures

| | Drying time | | | |
|---|---|---|---|---|
| Drying temp. (° C.) | 2 minutes | 5 minutes | 7 minutes | 10 minutes |
| 30 | 0.194 | 0.310 | 0.310 | 0.312 |
| 40 | 0.225 | 0.310 | 0.312 | 0.312 |
| 50 | 0.211 | 0.250 | 0.251 | 0.250 |
| 60 | 0.174 | 0.180 | 0.185 | 0.185 |
| 70 | 0.170 | 0.181 | 0.182 | 0.182 |
| 80 | 0.138 | 0.185 | 0.185 | 0.185 |
| 90 | 0.150 | 0.186 | 0.231 | 0.231 |

In another series of experiments, fabrics were padded in the same way, dried at 50° C. for 5 min, and then cured at various times and temperatures. The times, temperatures, and percent nitrogen fixation are shown in Table 17.

TABLE 17

Percent Nitrogen Fixed at Various Curing Times and Temperature

| | Curing time | | | | |
|---|---|---|---|---|---|
| Curing temp. (° C.) | 2 minutes | 5 minutes | 10 minutes | 15 minutes | 20 minutes |
| 50 | 0.096 | 0.100 | 0.137 | 0.150 | 0.175 |
| 60 | 0.105 | 0.120 | 0.165 | 0.178 | 0.187 |

TABLE 17-continued

Percent Nitrogen Fixed at Various Curing Times and Temperature

| | Curing time | | | | |
|---|---|---|---|---|---|
| Curing temp. (° C.) | 2 minutes | 5 minutes | 10 minutes | 15 minutes | 20 minutes |
| 70 | 0.123 | 0.141 | 0.171 | 0.189 | 0.216 |
| 80 | 0.131 | 0.169 | 0.170 | 0.216 | 0.221 |
| 90 | 0.149 | 0.180 | 0.199 | 0.223 | 0.240 |
| 100 | 0.175 | 0.210 | 0.340 | 0.255 | 0.255 |
| 110 | 0.278 | 0.309 | 0.311 | n/a | n/a |
| 120 | 0.295 | 0.309 | 0.308 | n/a | n/a |

n/a indicates that the experiment was not attempted.

Table 18 shows a series of experiments in which the CHTAC was applied at 69 g/L with 100% wet pickup, then dried at 50° C. for 5 min and finally cured at 115° C. for 4 min. In this series, the relative molar amounts of CHTAC and NaOH were varied as shown in Table 18.

TABLE 18

Percent Nitrogen Fixed as the Relative Molar Amount of NaOH Varied

| Sample | CHTAC g/L | NaOH g/L | mol ratio NaOH:CHTAC | % N |
|---|---|---|---|---|
| 1 | 69 | 7.32 | 0.50:1 | 0.045 |
| 2 | 69 | 8.00 | 0.55:1 | 0.045 |
| 3 | 69 | 9.56 | 0.65:1 | 0.042 |
| 4 | 69 | 11.0 | 0.75:1 | 0.052 |
| 5 | 69 | 12.4 | 0.85:1 | 0.055 |
| 6 | 69 | 13.2 | 0.90:1 | 0.053 |
| 7 | 69 | 16.0 | 1.10:1 | 0.055 |
| 8 | 69 | 17.6 | 1.20:1 | 0.109 |
| 9 | 69 | 19.1 | 1.30:1 | 0.150 |
| 10 | 69 | 22.0 | 1.50:1 | 0.264 |
| 11 | 69 | 24.2 | 1.70:1 | 0.268 |
| 12 | 69 | 26.4 | 1.80:1 | 0.297 |
| 13 | 69 | 29.4 | 2.00:1 | 0.298 |
| 14 | 69 | 32.4 | 2.20:1 | 0.297 |
| 15 | 69 | 35.2 | 2.40:1 | 0.298 |

The effect of varying CHTAC concentration in the pad bath is shown in Table 19. In this series of experiments, the padding solution was applied at 100% wet pickup, then dried at 35° C. for 5 min, and finally cured at 115° C. for 4 min. In this series, the relative molar ratio of NaOH:CHTAC was fixed at 2.2:1, and the CHTAC concentration was varied as indicated in Table 19.

TABLE 19

Effects of Varying CHTAC Concentration on Nitrogen Fixation

| Sample | CHTAC g/L | NaOH g/L | NaOH:CHTAC mol ratio | % N |
|---|---|---|---|---|
| 1 | 3.45 | 0.60 | 2.2:1 | 0.045 |
| 2 | 6.90 | 3.25 | 2.2:1 | 0.078 |
| 3 | 17.2 | 8.12 | 2.2:1 | 0.110 |
| 4 | 34.5 | 16.2 | 2.2:1 | 0.210 |
| 5 | 48.3 | 24.4 | 2.2:1 | 0.271 |
| 6 | 69.0 | 32.5 | 2.2:1 | 0.310 |
| 7 | 86.2 | 40.6 | 2.2:1 | 0.317 |
| 8 | 103.5 | 48.7 | 2.2:1 | 0.325 |
| 9 | 138.0 | 65.0 | 2.2:1 | 0.336 |

Finally, various additives to the padding bath were evaluated. In these experiments, solutions of 34.5 g/L CHTAC, 16.25 g/L NaOH and various additives as shown in Table 20 were padded onto fabrics at 100% wet pickup. Fabrics were then dried at 35° C. for 5 min and cured for 4 min at 115° C.

TABLE 20

Effects of Additives on Fixation using Pad-Dry-Cure Process

| Sample | Additive | Concentration of additive g/L | % N |
|---|---|---|---|
| 1 | Sodium chloride | 20 g/L | 0.220 |
| 2 | Sodium chloride | 30 g/L | 0.220 |
| 3 | Sodium chloride | 40 g/L | 0.214 |
| 4 | Sodium chloride | 50 g/L | 0.206 |
| 5 | Sodium acetate | 20 g/L | 0.220 |
| 6 | Sodium acetate | 30 g/L | 0.215 |
| 7 | Sodium acetate | 40 g/L | 0.212 |
| 8 | Sodium acetate | 50 g/L | 0.210 |
| 9 | Triethanol amine | 1 g/L | 0.245 |
| 10 | Triethanol amine | 3 g/L | 0.239 |
| 11 | Triethanol amine | 5 g/L | 0.223 |
| 12 | Sodium lauryl sulfate | 10 g/L | 0.220 |

The fixation for the drying and curing time and temperature experiments are shown in Table 21 and 22. In each case, the maximum error is estimated to be more than 3.9%.

Figure 3:
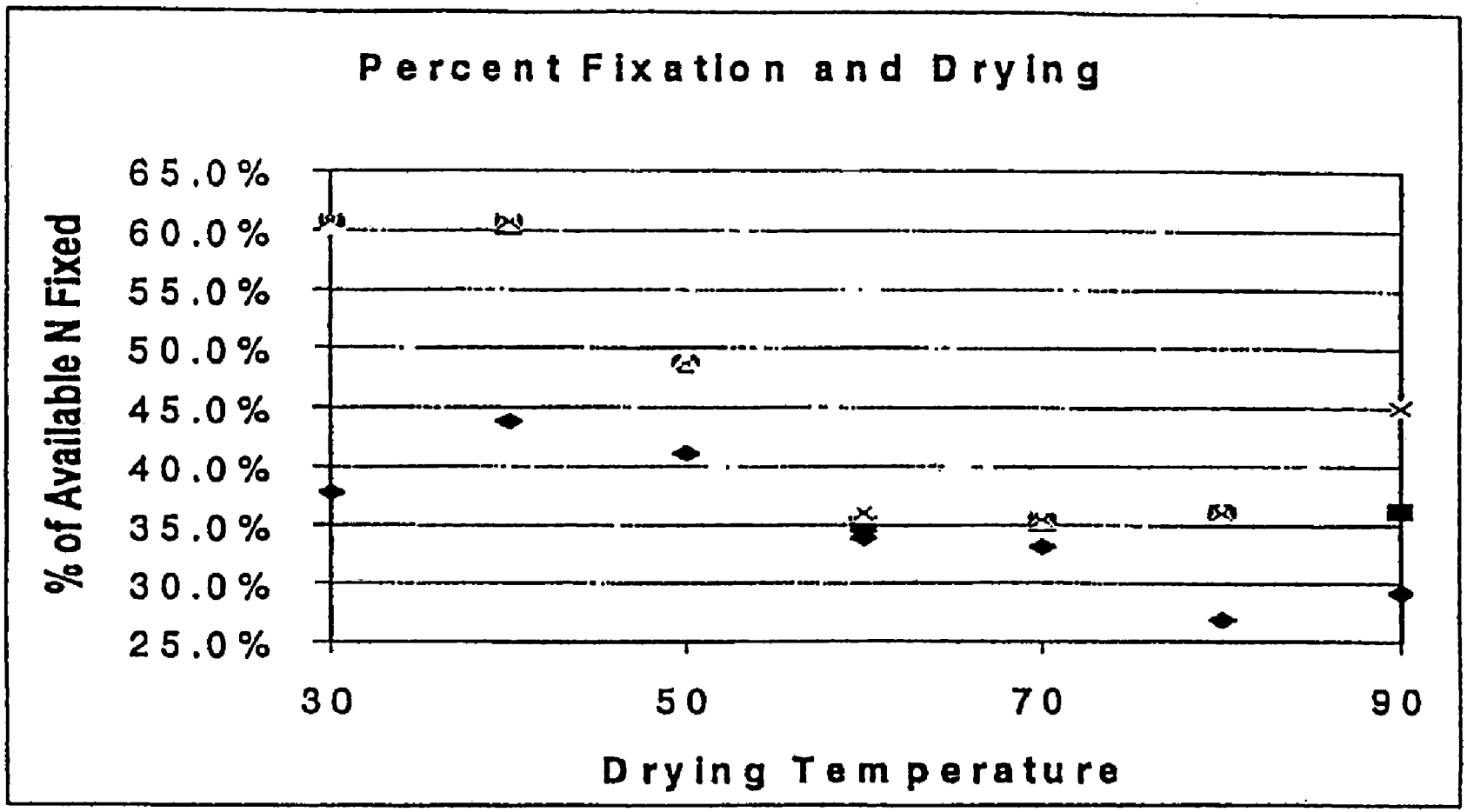
FIG. 3 shows the effect of drying conditions on the percent fixation for the pad-dry-cure application process described in Example 6.

At higher drying temperatures, the hydrolysis reaction is observed to take place, thereby reducing the percent fixation. Also, at lower drying temperatures, the samples are not completely dry, thereby leaving some residual water to react during the curing step. Close to optimum results are observed in the samples dried at or below 40° C. for 5 min or longer. Based on this observation, a preferred drying time and temperature was selected to be 35° C. for 5 min. These results are shown in FIG. 3.

TABLE 21

Percent Fixation at Various Drying Times and Temperatures

| | Drying time | | | |
|---|---|---|---|---|
| Drying temp. (° C.) | 2 minutes | 5 Minutes | 7 minutes | 10 minutes |
| 30 | 37.8% | 60.3% | 60.3% | 60.7% |
| 40 | 43.8% | 60.3% | 60.7% | 60.7% |
| 50 | 41.1% | 48.7% | 48.9% | 48.7% |
| 60 | 33.9% | 35.0% | 36.0% | 36.0% |
| 70 | 33.1% | 35.2% | 35.4% | 35.4% |
| 80 | 26.9% | 36.0% | 36.0% | 36.0% |
| 90 | 29.2% | 36.2% | 45.0% | 45.0% |

TABLE 22

Percent Fixation at Various Curing Times and Temperatures

| | Curing time | | | | |
|---|---|---|---|---|---|
| curing temp. (° C.) | 2 minutes | 5 minutes | 10 minutes | 15 minutes | 20 minutes |
| 50 | 18.7% | 19.5% | 26.7% | 29.2% | 34.1% |
| 60 | 20.4% | 23.4% | 32.1% | 34.6% | 36.4% |
| 70 | 23.9% | 27.4% | 33.3% | 36.8% | 42.0% |
| 80 | 25.5% | 32.9% | 33.1% | 42.0% | 43.0% |
| 90 | 29.0% | 35.0% | 38.7% | 43.4% | 46.7% |
| 100 | 34.1% | 40.9% | 66.2% | 49.6% | 49.6% |
| 110 | 54.1% | 60.1% | 60.5% | n/a | n/a |
| 120 | 57.4% | 60.1% | 59.9% | n/a | n/a |

n/a indicates that the experiment was not attempted.

Figure 4:
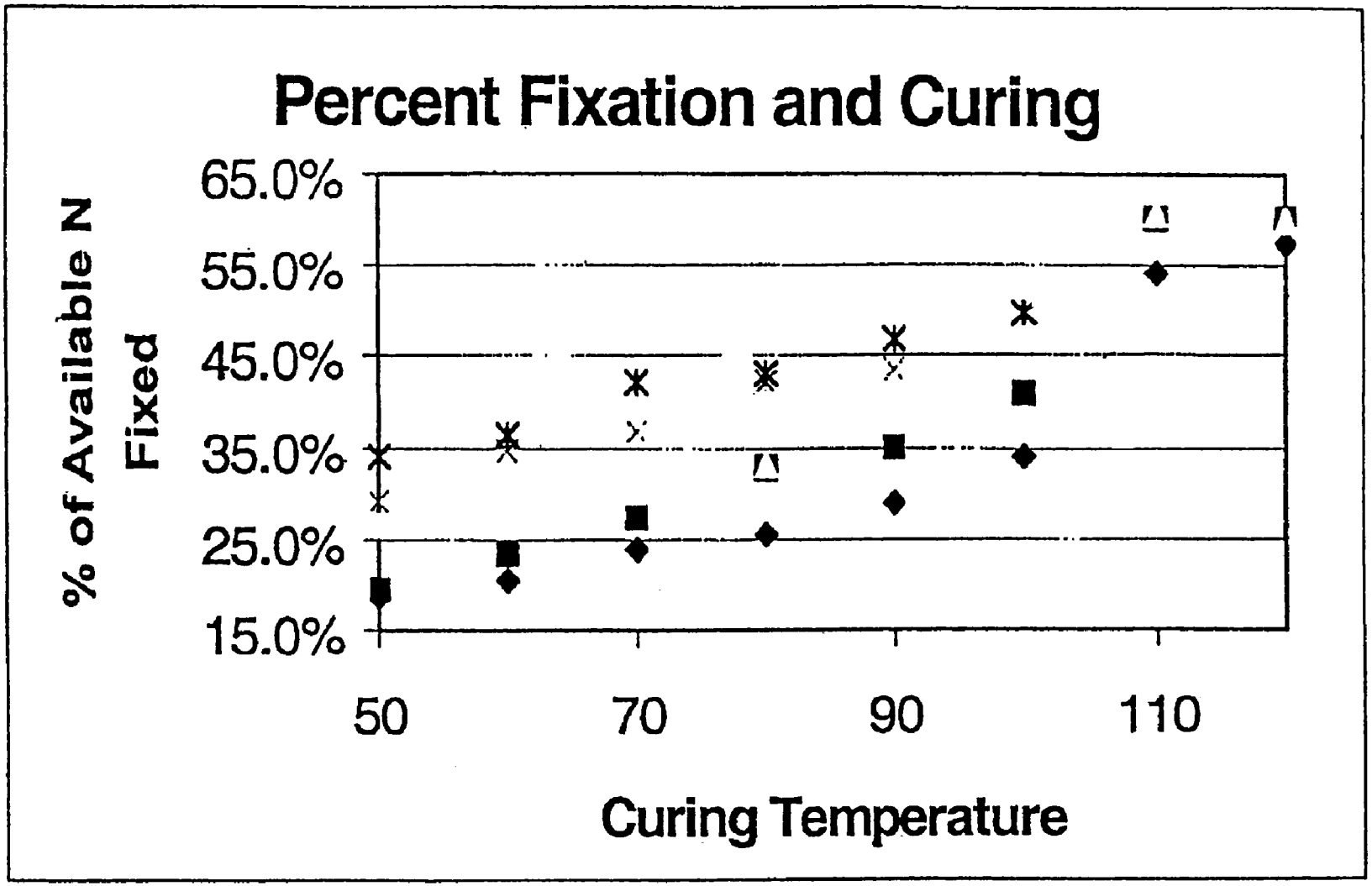
FIG. 4 shows the effect of curing conditions on the percent fixation for the pad-dry-cure application process described in Example 6.

The data in Table 22 show that the reaction of EPTAC with cellulose is more efficient at temperatures at or above 110° C. Drying times of 5 min and longer are sufficient. These results are shown in FIG. 4.

Figure 5:
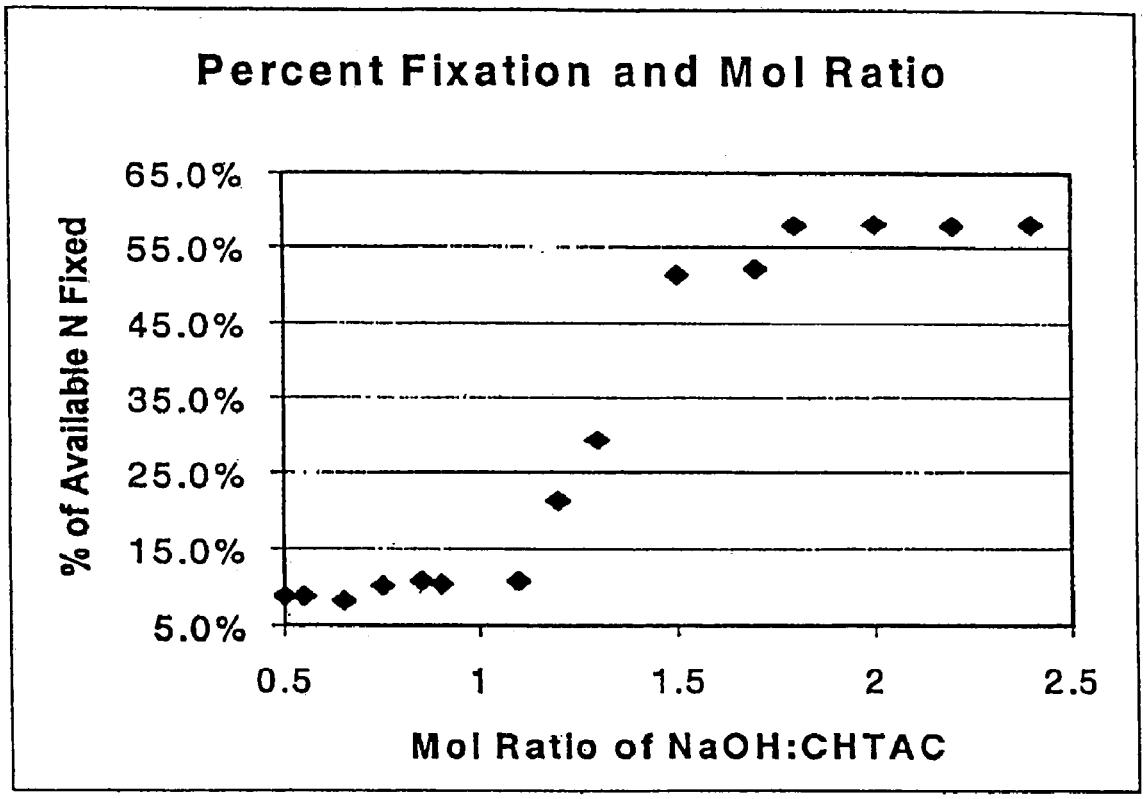
FIG. 5 shows the effect of the mol ratio of NaOH to CHTAC on the pad-dry-cure application process described in Example 6.

The effects of concentration, NaOH:CHTAC mol ratio, and additives are provided in Table 23. FIG. 5 shows the effect of varying the mol ratio of NaOH:CHTAC in the pad-dry-cure application. Preferred results are obtained with a mole ratio of 1.8:1 or higher for NaOH:CHTAC.

Figure 6:
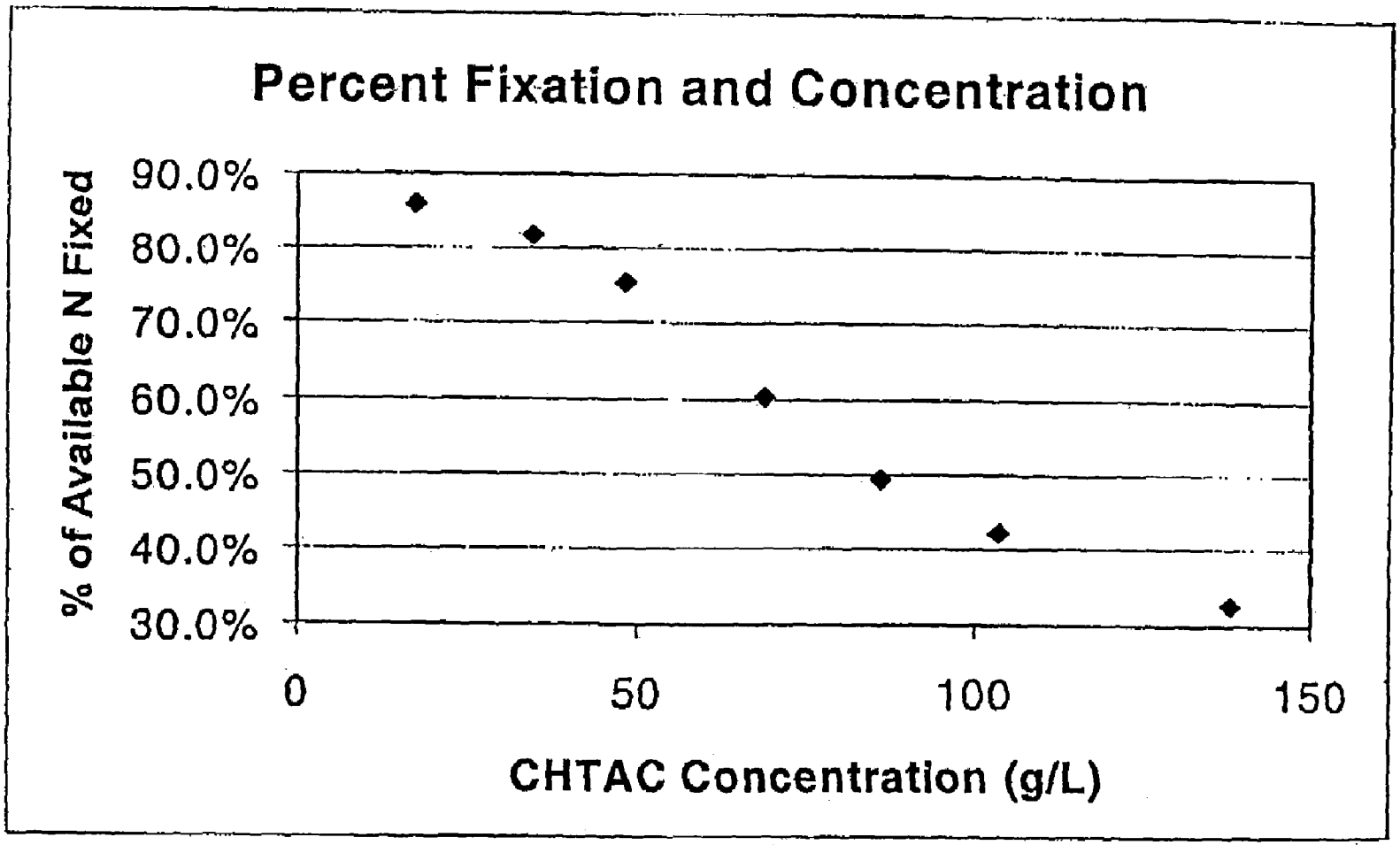
FIG. 6 shows the effect of varying the CHTAC concentration on the pad-dry-cure application process described in Example 6.

The concentration series data shown in FIG. 6 reflect a decrease in fixation similar to the trend shown in FIG. 2 for the pad-batch application process. The first two data for the very low concentrations, showing fixations of more than 100% are biased to higher values for the reasons previously discussed.

TABLE 23

Percent Fixation for the Pad-Dry-Cure Method

| Sample | Table 18 0.514% applied NaOH:CHTAC ratio Max error = 3.9% | Table 19 applied varies Concentration Max error (*) | Table 20 0.257% applied Additives Max error = 7.8% |
|---|---|---|---|
| 1 | 8.8% | 175.2% (77.8%) | 85.6% |
| 2 | 8.8% | 151.8% (38.7%) | 85.6% |
| 3 | 8.2% | 85.9% (15.6%) | 83.3% |
| 4 | 10.1% | 81.7% (7.8%) | 80.2% |
| 5 | 10.7% | 75.3% (5.6%) | 85.6% |
| 6 | 10.3% | 60.3% (3.9%) | 83.7% |
| 7 | 10.7% | 49.4% (3.1%) | 82.5% |
| 8 | 21.2% | 42.2% (2.6%) | 81.7% |
| 9 | 29.2% | 32.7% (1.9%) | 95.4% |
| 10 | 51.4% | | 93.0% |
| 11 | 52.2% | | 86.8% |
| 12 | 57.8% | | 85.6% |
| 13 | 58.0% | | |
| 14 | 57.8% | | |
| 15 | 58.0% | | |

As shown in the rightmost column of Table 23 (data from Table 20), additives of various types did not make a significant difference in the fixation. The somewhat higher values of fixed nitrogen for samples 9,10, and 11 are not due to fixation of CHTAC, but are due to the extra nitrogen from the triethanolamine additive used in these experiments.

Discussion of Examples 3–6

For comparison purposes, it is useful to discuss the percent nitrogen data in terms of the percent fixation, i.e., the percent of the total applied CHTAC that is fixed, based on the nitrogen analysis of the fabric. As an example calculation, Sample #1 in Table 6 was produced by padding with an 86.25 g/L CHTAC solution at 100% wet pickup. The molecular weight of CHTAC is 188. Thus, the nitrogen available is 6.42 g of nitrogen per kg of fabric, or 0.642% on weight of goods. The actual amount of nitrogen fixed for that particular sample, as determined by elemental analysis, is 0.160%. Thus, the percent fixation for that sample is 0.160/0.642 or 25%—that is, 25% of the applied CHTAC is fixed and 75% is hydrolyzed. The following discussions of processes are based on percent fixation as defined by the previous example calculation.

Based on extensive experience with replicate data and comparison of the elemental analysis to K/S values from dyeing, the accuracy of the nitrogen elemental analysis at low levels (<0.100% nitrogen detected) is estimated to be about 0.020%. In other words, contamination of samples or apparatus, or failure to achieve complete removal of unfixed fabric may produce a bias toward apparently higher values of fixed nitrogen of up to 0.020%. Two examples are presented below to illustrate the uncertainty of the reported fixation values.

Example A: Applied nitrogen=0.400%
- Detected nitrogen=0.200%
- Fixation=0.200/0.400=50%
- Accuracy of fixation determination=0.020/0.400=5%
- Range of values for fixation=50% to 55%
- The fixation uncertainty is 10% of its value.

Example B: Applied nitrogen=0.400%
- Detected nitrogen=0.040%
- Fixation=0.040/0.400=10%
- Accuracy of fixation determination=0.020/0.400=5%
- Range of values for fixation=10% to 15%
- The fixation uncertainty is 50% of its value.

None of the values are estimated to be in error by more than 5% (absolute).

The percent fixation and fixation efficiency for several similarly treated samples are shown in Table 24. In each case, the fabric was treated with 34.5 g/L of CHTAC. The values of fixation efficiency (E, as in equation 8) are calculated from the percent fixation (% F) from the definitions:

$$\%\ F=100(\text{amount fixed/total amount})=(100E)/(E+1) \quad (9)$$

or, solving for E, $$E=\%\ F/(100-\%\ F)$$

TABLE 24

Comparison of Percent Fixation for Various Methods

| Method | Table, Sample | Percent Fixation (% F) | Efficiency (E) | L | 1/L |
|---|---|---|---|---|---|
| Exhaust | 12, 5 | 0.9% | 0.00908 | 20 | 0.05 |
| Pad-stream | No table | 27.6% | 0.381 | 1.5* | 0.5 |
| Pad-dry-stream | No table | 50.6% | 1.02 | 0.5* | 1 |
| Pad-batch | 9, 6 | 2.8% | 0.288 | 1 | 1 |
| Pad-dry-cure | 13, 4 | 81.7% | 4.46 | 0 | |

*Estimated, based on wet pickup plus absorption of moisture from steam

Figure 7:
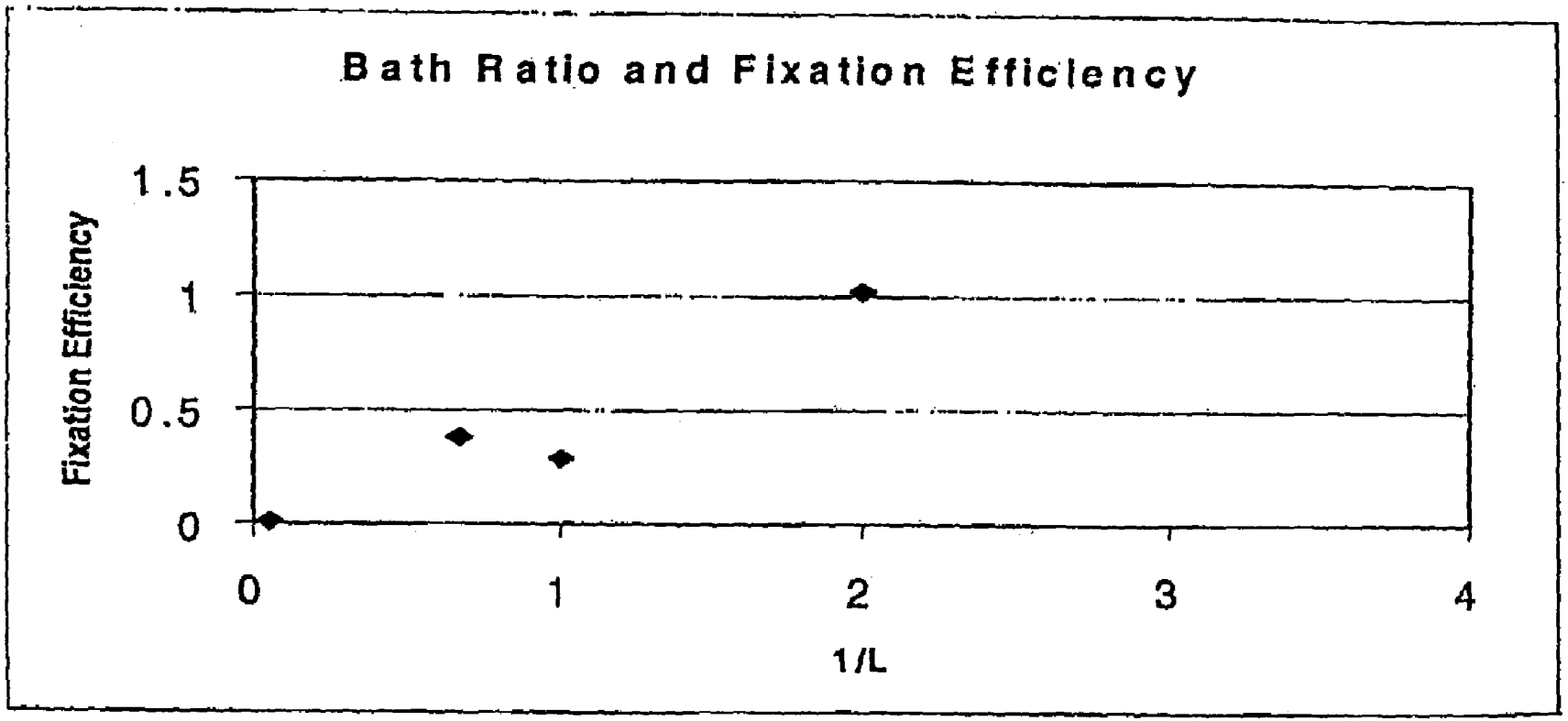
FIG. 7 shows the relationship between bath ratio and fixation efficiency for similarly treated cellulosic fabrics.

The model of equation 8 predicts that fixation efficiency is inversely proportional to bath ratio, all other factors being equal. Of course, these are only qualitative predictions, due to the lack of specific values for model parameters. As shown in FIG. 7, the qualitative trend, however, is evident.

Looking at the factors in the model analysis presented, equation (8)

$$E=(RK^{n}/L)([\text{CellO}^{-}]/[\text{OH}^{-}])^{m} \quad (8)$$

shows qualitative effects of various parameters. For example, the a preferred mol ratio of NaOH:CHTAC is 2.2:1. As to the reaction rate, R, pretreatment of substrates did not yield any method of improvement of the reaction rate with cellulose. Likewise, additives to the processes seemed to have little or no effect in increasing the value of R. The use of inert solvents, e.g., acetone, gave much higher cationization reaction efficiencies by eliminating (or reducing) the potential for hydrolysis by eliminating water.

As to the value of the distribution coefficient, K, the use of additives gave litter improvement in fixation. Even the use of anionic surfactants, which might be expected to complex with CHTAC or EPTAC in solution and then exhaust on to the cellulosic substrate, provided little or no improvement.

The bath ratio, L, was a major overriding factor. Elimination of water during the reaction, by pad-dry-cure, pad-dry-stream, or use of an inert solvent, enhances fixation.

Of the processes tested in Examples 3–6, the exhaust method is the least efficient, with typically about 5% yield or less. The pad-batch and pad-steam processes are more efficient, with fixation up to 40% to 50%. Pad-dry-cure processes performed under preferred conditions can give yields around 85%. An important aspect in the pad-dry-cure application is the elimination of water from the system prior to increasing temperature to a high level where the reactions can proceed rapidly.

Further, for all application processes disclosed herein, fixation is higher at lower applied concentration, and drops off sharply as concentration increases. This result suggests a new approach, i.e., use of several applications with lower concentrations rather than a single application at high concentration.

Example 7

Cationic Cotton Cross Linking with Low Molecular Weight Anionic Cross-Linkers In some embodiments, as described herein, cationic cotton is crosslinked with low molecular weight, e.g., non-polymeric, anionic cross-linkers.

7.1 Materials

Cationic cotton samples were prepared by reaction of a CR-2000/NaOH mixture with cotton fabric samples by a cold patch method as described by Hashem, M., et al., Textile Res. J., 73(11), 1017(2003), which is incorporated herein by reference. Two different cationization levels of cotton (33.1 mmol/100 g fabric and 41 mmol/100 g fabric) were used. The cationization percentages of samples (33.1 mmol/100 g and 41 mmol/100 g) were determined by plotting the K/S values of dyed treated samples versus the % Nitrogen fixed. The pH of the fabric (pH=7.7) was determined by using AATCC test method 81-2000 before cross-linking.

Five different polyanions were investigated:

(a) polycarboxylic acid (polyacrylic acid)

(b) 1,2,3,4-butanetetracarboxylic acid (c) oxalic acid (d) malic acid (e) citric acid 7.2 Preparation of Solutions (a) Mix 20 g polycarboxylic acid in 180 g of water to yield an approximately 5% (w/w) solution.

(b) Mix 20 g 1,2,3,4-butanetetracarboxylic acid in 180 mL of water to yield a 0.5 M solution.

(c) Mix 9 g oxalic acid in 200 mL of water to yield a 0.5 M solution.

(d) Mix 13.4 g malic acid in 200 mL of water to yield a 0.5 M solution.

(e) Mix 19.2 g citric acid in 200 mL of water to yield a 0.5 M solution.

7.3 Application

The following pad-dry-cure method was used: Pad (100% wpu)—(dry (85° C. for 3 min)—cure (140° C. for 2.5 min). The treated samples were then washed with 2 g/L nonionic surfactant and dried for 85° C. for 3 min.

7.4 Evaluation

The treated cotton samples were conditioned overnight at room temperature and the WRAs were tested by using AATCC TM#66 Option#2.

TABLE 25

Cationic Cotton Cross Linking with Low Molecular Weight Anionic Cross-linkers.

| Cationization (mmol/100 g) | Cross-linker | Dry/Wet WRA |
|---|---|---|
| 33.1 | Polycarboxylic acid | 173/173 |
| | 1,2,3,4-butanetetracarboxylic acid | 177/181 |
| | Oxalic acid | 160/178 |
| | Malic acid | 154/170 |
| | Citric acid | 160/182 |
| 41 | Polycarboxylic acid | 169/232 |
| | 1,2,3,4-butanetetracarboxylic acid | 175/241 |
| | Oxalic acid | 106/186 |
| | Malic acid | 140/188 |
| | Citric acid | 154/204 |
| Blank | Non-treated | 145/128 |

Example 8

Anionic Cotton Cross Linking with Low Molecular Weight Cationic Cross-Linkers In some embodiments, anionic cotton is crosslinked with a low molecular weight (non-polymeric) cationic cross-linkers.

8.1 Materials

Anionic cotton samples were prepared using a sodium salt of monochloroacetic acid. Two different carboxyl contents (30.2 mmol/g and 60.7 mmol/g) were used. The cationic molecules, e.g., cationic glycerin, cationic ethylene glycol, cationic dextrose, and cationic cellobiose, were prepared by the reaction of 3-chloro-2-hydroxypropyl trimethyl ammonium chloride (CHTAC) (Dow CR2000®, 69% CHTAC solution (The Dow Chemical Company, Midland, Mich., United States of America)) with these small molecular weight molecules under alkali conditions. Reaction mixtures were cooled and the pH was adjusted to a pH of 7 with acetic acid.

8.2 Preparation of Solutions

Cross-linker solutions were prepared from reaction mixtures without purification. Solid contents of reaction mixtures were obtained by drying a known amount of each reaction mixture sample at 70° C. for 24 hrs. A 200 mL solution with a concentration of 6% (w/w) of each cationic molecule was prepared.

8.3 Application

The following pad-dry-cure procedure was followed: pad (100% wpu)—dry (85° C. for 3 min)—cure (140° C. for 2.5 min). The treated samples were then washed with 2 g/L nonionic surfactant and dried at 85° C. for 3 min.

8.4 Evaluation

The treated cotton samples were conditioned overnight at room temperature and WRAs were tested by using AATCC TM#66 Option 2.

TABLE 26

Anionic Cotton Cross Linking with Low Molecular Weight Cationic Cross-Linkers

| Carboxyl content (mmol/100 g) | Cross-linker | Dry/Wet WRA |
|---|---|---|
| 30.2 | Cationic Glycerine | 212/236 |
| | Cationic Ethylene Glycol | 213/209 |
| | Cationic Dextrose | 202/216 |
| | Cationic D-Cellobiose | 212/214 |
| 60.7 | Cationic Glycerine | 213/233 |
| | Cationic Ethylene Glycol | 210/220 |
| | Cationic Dextrose | 205/215 |
| | Cationic D-Cellobiose | 208/214 |
| Blank | Non-treated | 145/128 |

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A process for producing an ionic crosslinked fibrous material, the process comprising:

(a) providing an aqueous solution of a low molecular weight anion, wherein the low molecular weight anion is selected from the group consisting of polyacrylic acid, 1,2,3,4-butanetetracarboxylic acid, oxalic acid, malic acid, and citric acid;

(b) providing a cationic fibrous material;

(c) padding the cationic fibrous material through the aqueous solution of a low molecular weight anion to form a padded cationic fibrous material;

(d) drying the padded cationic fibrous material at a first temperature range to form a dried cationic fibrous material; and (e) curing the dried cationic fibrous material at a second temperature range to form a crosslinked ionic fibrous material.

2. The process of claim 1, wherein the cationic fibrous material is formed by reacting a fibrous material with a cationizing agent.

3. The process of claim 2, wherein the fibrous material is selected from one of a synthetic fibrous material and a natural fibrous material.

4. The process of claim 3, wherein the natural fibrous material comprises cotton.

5. The process of claim 2, wherein the cationizing agent comprises 3-chloro-2-hydroxypropyl trimethyl ammonium chloride (CHTAC).

6. The process of claim 1, wherein the first temperature range comprises about 70° C. to about 100° C.

7. The process of claim 1, wherein the second temperature range comprises about 125° C. to about 155° C.

8. The process of claim 1, wherein curing the dried cationic fibrous material at a second temperature range forms a crosslinked ionic fibrous material having a dry wrinkle recovery angle ranging from about 145 degrees to about 180 degrees.

9. The process of claim 1, wherein curing the dried cationic fibrous material at a second temperature range forms a crosslinked ionic fibrous material having a wet wrinkle recovery angle ranging from about 130 degrees to about 250 degrees.

10. A process for producing an ionic crosslinked fibrous material, the process comprising:

(a) providing an aqueous solution of a low molecular weight cation, wherein the low molecular weight cation is selected from the group consisting of cationic glycerine, cationic ethylene glycol, cationic dextrose, and cationic D-cellobiose;

(b) providing an anionic fibrous material, wherein the anionic fibrous material is formed by reacting a fibrous material with one of the group consisting of a vinyl sulfone, an anionic chlorotriazine compound, chloroacetic acid, a salt of chloroacetic acid, and sodium chloromethyl sulfonate;

(c) padding the anionic fibrous material through the aqueous solution of the low molecular weight cation to form a padded anionic fibrous material;

(d) drying the padded anionic fibrous material at a first temperature range to form a dried anionic fibrous material; and (e) curing the dried anionic fibrous material at a second temperature range to form a crosslinked ionic fibrous material.

11. The process of claim 10, wherein the anionic fibrous material is formed by reacting a fibrous material with a sodium salt of monochloroacetic acid.

12. The process of claim 11, wherein the fibrous material is selected from one of a synthetic fibrous material and a natural fibrous material.

13. The process of claim 12, wherein the natural fibrous material comprises cotton.

14. The process of claim 10, wherein the first temperature range comprises about 70° C. to about 100° C.

15. The process of claim 10, wherein the second temperature range comprises about 125° C. to about 155° C.

16. The process of claim 10, wherein curing the dried anionic fibrous material at a second temperature range forms a crosslinked ionic fibrous material having a dry wrinkle recovery angle ranging from about 145 degrees to about 215 degrees.

17. The process of claim 10, wherein curing the dried anionic fibrous material at a second temperature range forms a crosslinked ionic fibrous material having a wet wrinkle recovery angle ranging from about 130 degrees to about 250 degrees.

* * * * *